US005874932A

United States Patent [19]

Nagaoka et al.

[11] Patent Number: 5,874,932

[45] **Date of Patent: *Feb. 23, 1999**

[54] PLASMA DISPLAY DEVICE

[75] Inventors: Keishin Nagaoka; Naoki Matsui; Yoshikazu Kanazawa, all of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 367,971

[22] Filed: Dec. 29, 1994

[30] Foreign Application Priority Data

Oct. 31, 1994 [JP] Japan ..... 6-267344

[51] Int. Cl.[6] ..... G09G 3/22

[52] U.S. Cl. ..... 345/60; 345/63; 345/72

[58] Field of Search ..... 345/60, 67, 94, 345/55, 63, 68, 61, 62; 313/586, 169.3; 315/169

[56] References Cited

U.S. PATENT DOCUMENTS

| | | | |
|---|---|---|---|
| 3,906,290 | 9/1975 | Kurahashi et al. | 315/169 |
| 4,097,780 | 6/1978 | Ngo | 345/63 |
| 4,385,293 | 5/1983 | Wisnieff | 345/63 |
| 5,247,288 | 9/1993 | Warren et al. | 345/68 |
| 5,250,937 | 10/1993 | Kikuo et al. | 345/94 |
| 5,420,602 | 5/1995 | Kanazawa | 345/67 |
| 5,436,634 | 7/1995 | Kanazawa | 345/67 |
| 5,436,637 | 7/1995 | Kanazawa | 345/67 |
| 5,446,344 | 8/1995 | Kanazawa | 313/586 |
| 5,541,618 | 7/1996 | Shinoda | 345/60 |
| 5,583,527 | 12/1996 | Fujisaki et al. | 345/60 |

FOREIGN PATENT DOCUMENTS

| | | |
|---|---|---|
| 488891 | 11/1991 | European Pat. Off. . |
| 549275 | 12/1992 | European Pat. Off. . |
| 2694118 | 7/1993 | France . |
| 3138691 | 6/1991 | Japan . |
| 419188 | 7/1992 | Japan . |

*Primary Examiner*—Steven Saras
*Assistant Examiner*—John Suraci
*Attorney, Agent, or Firm*—Greer, Burns, & Crain, Ltd.

[57] ABSTRACT

A plasma display device is capable of creating a screen of high quality without generating half tone noise in the succeeding frames irrespective of the arrangement or the turn-on state of the subframes in a preceding frame that is being displayed. A picture of a frame is displayed on a plasma display device by combining a plurality of subframes SF1 and Sfn having different degrees of brightness. Each of the plurality of subframes SF1 and Sfn includes a totally writing and totally self-erasing period S1, an address period S2, a sustain discharge period S3, and a quiescent period S4 determined by a difference between the sum of the periods S1 to S3 and a period of a vertical synchronizing signal Vsync. A period S5 for imparting a discharge waveform different from the sustain discharge waveform applied across the electrodes is provided in the sustain discharge period S3 between the quiescent period S4 in the predetermined frame FM1 and the totally writing and totally self-erasing period S1 in the succeeding frame FM2.

19 Claims, 20 Drawing Sheets

Fig. 8(a)

| PATTERN | FRAME 1 | | | | | FRAME 2 | | | | | COMMENT |
|---|---|---|---|---|---|---|---|---|---|---|---|
| | SF1 | SF2 | SF3 | SF4 | QUIESCENT PERIOD | SF1 | SF2 | SF3 | SF4 | QUIESCENT PERIOD | |
| a | ON | — | — | ON | — | ~~ON~~ | — | — | ON | — | NOISE IN SF1 OF FRAME 2 |
| b | — | — | ON | ON | — | — | — | ~~ON~~ | ON | — | NOISE IN SF3 OF FRAME 2 |
| c | ON | — | ON | — | — | ON | — | ON | — | — | NO NOISE |

| | SF1 | SF2 | SF3 | SF4 | SF5 | SF6 | SF7 | · · · |
|---|---|---|---|---|---|---|---|---|
| BEFORE CHANGED | 1 | 2 | 4 | 8 | 16 | 32 | 64 | · · · |
| AFTER CHANGED | 0 | 1 | 3 | 7 | 15 | 31 | 63 | · · · |

Fig. 19

| | | | | | | |
|---|---|---|---|---|---|---|
| REFERENCE SEQUENCE OF SF | SF | NO. | 1 | 2 | 3 | 4 |
| | | BRIGHTNESS RATIO | 1 | 2 | 4 | 8 |
| | NUMBER OF DISPLAY CELLS | | 0 | 5000 | 10 | 10000 |
| AFTER THE SEQUENCE OF SF IS CHANGED | SF | NO. | 2 | 3 | 4 | 1 |
| | | BRIGHTNESS RATIO | 2 | 4 | 8 | 1 |
| | NUMBER OF DISPLAY CELLS | | 5000 | 10 | 10000 | 0 |

PLASMA DISPLAY DEVICE

BACKGROUND OF THE INVENTION

1. Field of the Invention

The AC-type PDPs can be grouped into those of the two electrode type which effect the selective discharge (address discharge) and sustain discharge using two electrodes and those of the three electrode type which effect the address discharge using a third electrode.

In the color PDP that effects the gradation display, the fluorescent material formed in the discharge cell is excited by ultraviolet rays generated by an electric discharge. The fluorescent material, however, is not resistant to the bombardment of ions which create a positive charge generated by the electric discharge. In the two-electrode type device in which the ions directly hit upon the fluorescent material, it is likely that the fluorescent material has a short life.

In order to avoid this, the color PDP usually employs a three-electrode structure utilizing surface discharge. Even the three electrode-type devices can be grouped into those in which the third electrode is formed on a substrate on which are arranged the first and second electrodes for effecting the sustain discharge, and those in which the third electrode is disposed on another opposing substrate.

Moreover, the devices in which the three electrodes are formed on the same substrate can be further grouped into those in which the third electrode is arranged on the two electrodes that effect the sustain discharge, and those in which the third electrode is arranged under the two electrodes.

Furthermore, visible light emitted from the fluorescent material may be viewed through the fluorescent material (transmission type) or after it is reflected by the fluorescent material (reflection type). The cell that effects the electric discharge has been cut for its spatial linkage to the neighboring cell by a barrier wall (rib portion or barrier).

In another example, the barrier walls are provided on four sides to surround the discharging cell in a completely sealing manner, or the barrier walls are provided in one direction only; but in another direction, the spatial linkage between the discharging cell and the neighboring cell can be cut by normalizing a gap (distance) between the electrodes.

The present invention relates to a plasma display device (PDP) as explained above and to a driving method thereof.

2. Description of the Related Art

In this specification, the explanation about the present invention will be given utilizing a specific embodiment of a plasma display device 1 according to the present invention in which a third electrode (address electrode) is formed on a substrate which opposes a substrate of electrodes that effect the sustain discharge. In this plasma display device of the reflection type, the barrier wall is formed in the vertical direction only (i.e., at right angles with the first electrode which may be the X-electrode and the second electrode which may be the Y-electrode, and is in parallel with the third electrode), and the sustain electrode is partly constituted by a transparent electrode. It should, however, be noted that the present invention is in no way limited to the constitution of this embodiment only, and the technical features of the present invention can be applicable to all of the different kinds of plasma display panels.

FIG. 1 is a plan view which schematically illustrates the constitution of the PDP of the above-mentioned three-electrode surface-discharge type according to the embodiment, FIG. 2 is a sectional view (in the vertical direction) which schematically illustrates a discharge cell in the panel of FIG. 1, and FIG. 3 is a sectional view which schematically illustrates the discharge cell in a horizontal direction but at right angles with that of FIG. 2.

A panel 1 is constituted by two glass substrates 4 and 5. On the first substrate 4 are provided a first electrode, i.e., X-electrode XD and a second electrode, i.e., Y-electrode YD that are sustain electrodes 10 arranged in parallel. These electrodes XD and YD are constituted by a transparent electrode 9 and a bus electrode 8.

The transparent electrode 9 must permit the light 12 reflected by a fluorescent material 11 to pass through, and is composed of, for example, ITO (transparent conductor film composed chiefly of indium oxide) or the like. In order to prevent the voltage drop caused by the electrode resistance, furthermore, the bus electrode 8 must have a small resistance and is, hence, composed of Cr or Cu. These electrodes are further covered with a dielectric layer (glass) 7, and a MgO (magnesium oxide) film is formed as a protection film 6 on the discharge surface.

In the second substrate 5 opposing the first glass substrate 4 is formed a third electrode (address electrode) AD in a manner to be at right angles with the sustain electrodes 10. Furthermore, barrier walls 2 are formed between the address electrodes AD, and fluorescent materials 11 having red-, green- and blue-light emitting properties are arranged between the barrier walls 2 in a manner to cover the address electrodes AD.

The two glass substrates 4 and 5 are assembled in a manner that the ridges of the barrier walls 2 and the surface of the MgO film 6 are brought into intimate contact with each other.

Light-emitting cell portions 3 are formed near the intersecting points of the X- and Y-electrodes XD, TD and the address electrodes AD in a region surrounded by the barrier walls 2.

FIG. 4 is a block diagram which schematically illustrates peripheral circuits for driving the plasma display device (PDP) shown in FIGS. 1 and 2. Each address electrode AD is connected to the address driver 13 which applies an address pulse at the time of address discharge.

The Y-electrodes YD1 to YDn are each connected to a Y-scan driver 14 which is connected to a Y-side common driver 15. The Y-scan driver 14 generates a pulse at the time of address discharge, and a sustain pulse is generated by the Y-side common driver 15 and is applied to the Y-electrodes YD1 to YDn through the Y-scan driver 14.

The X-electrodes XD are connected and are taken out in common over the whole display lines of the panel 1.

An X-side common driver 16 generates a write pulse, a sustain pulse and like pulses. The driver circuit 16 is controlled by a control circuit 17.

The control circuit 17 is constituted by a display data control unit 18 that includes a frame memory 19, and a panel drive control unit 20 that includes a scan driver control unit 21 and a common driver control unit 22, and is controlled by synchronizing signals Vsync, Hsync and a display data signal DATA that are input from external units.

FIG. 5 is a diagram of waveforms according to a prior method of when the plasma display device (PDP) shown in FIGS. 1 to 3 is to be driven by a circuit shown in FIG. 4, and illustrates voltage waveforms on the electrodes during the period of a sub-field (SF) according to a conventional so-called "address/sustain discharge period separation-type write address system".

In this example, the sub-field SF is divided into a reset period S1 used for the initialization, an address period S2 and a sustain discharge period S3.

The reset period is used for executing the initializing operation such as for executing the total erasure, total self erasure and total writing and total self erasure.

Furthermore, since the period of one frame for displaying the screen has been roughly determined by the period of a vertical synchronizing signal Vsync, a quiescent period S4 of a predetermined length that can be varied is inevitably formed by a difference between one period of a vertical synchronizing signal and the sum of the reset period S1, the address period S2 and the sustain discharge period S3.

In the above-mentioned reset period S1, first, the Y-electrodes YD1 to YDn all assume a 0-V level and, at the same time, a total writing pulse of a voltage Vs+Vw (about 330 V) is applied to the X-electrodes XD. As a result, the electric discharge takes place in all cells of all display lines irrespective of the preceding display state.

In this case, the address electrode potential is about 100 V (Vaw). Then, the potential becomes 0 V at the X-electrode and the address electrode, and the voltage of the wall charge exceeds the discharge start voltage of all cells 3; i.e., the discharge takes place. Since there is no potential difference among the electrodes, no wall charge is formed by the discharge. That is, the discharge is a so-called self-erasing discharge in which a space charge is self-neutralized to terminate the discharge.

Due to the self-erasing discharge, all cells 3 in the panel 1 acquire a uniform state without a wall charge. The reset period S1 allows all of the cells to acquire the same state irrespective of the turn-on state of the preceding sub-field, and enables the next address (write) discharge to be stably carried out.

In the next address period S2, an address discharge is carried out in the order of lines to turn the cells 3 on and off depending upon the display data.

First, a scan pulse SCP of a −VY level (about minus 150 V) is applied to each of the Y-electrodes YD1 to YDn, an address pulse ADP of a voltage Va (about 50 V) is selectively applied to an address electrode ADn that corresponds to a cell 3 which is to effect sustain discharge, i.e., which is to be turned on, among the address electrodes AD1 to ADn, and the discharge is permitted to take place between the address electrode ADn of the cell 3 that is to be turned on and the Y-electrode YDn.

By using this discharging operation as a primer (igniting fire), an electric discharge is readily established between the X-electrodes XD (voltage Vx=50 V) and the Y-electrodes YD1 to YDn.

This enables the wall charge of an amount that causes sustain discharge to be accumulated in the MgO film 6 on the X-electrode XD of a selected cell of a selected line and on the Y-electrodes YD1 to YDn.

The same operation is carried out successively for other display lines, and the display data are newly written in all of the display lines.

Then, in the sustain discharge period S3, a sustain pulse SUSP having a voltage Vs (about 180 V) is alternately applied across the Y-electrodes YD1 to YDn and the X-electrodes to effect the sustain discharge, whereby the image of one sub-field is displayed.

That is, in the above-mentioned embodiment, a period in which a sustain pulse SUSP is alternately applied across the Y-electrode YDn and the X-electrode is called one cycle of the sustain discharge period.

In the plasma display device of the above-mentioned conventional address/sustain discharge separation type write address system, the brightness is determined depending upon the duration of the sustain discharge period S3, i.e., depending upon the number of the sustain pulses SUSP.

FIG. 6 illustrates a method of driving the plasma display device for effecting the multi-gradation display which, in this case, is a 256-gradation display.

In this embodiment, one frame is divided into eight sub-fields, i.e., SF1, SF2, SF3, SF4, SF5, SF6, SF7 and SF8.

In these sub-fields SF1 to SF8, the reset periods S1 and the address periods S2 have the same length.

The lengths of the sustain discharge periods comply with a ratio 1:2:4:8:16:32:64:128.

By selectively combining the sub-fields that are to be turned on, therefore, 256 stages of brightness can be displayed from 0 to 255.

Described below is a practical time sharing. If the screen is rewritten at 60 Hz, one frame lasts 16.6 ms (1/60 Hz). If the number of times of the sustain discharge cycles (sustain cycles) in one frame is 510 times, the numbers of sustain discharge cycles in each of the sub-fields are 2 cycles in SF1, 4 cycles in SF2, 8 cycles in SF3, 16 cycles in SF4, 32 cycles in SF5, 64 cycles in SF6, 128 cycles in SF7 and 256 cycles in SF8.

If the duration of the sustain discharge cycle is 8 μs, then the total duration of one frame is 4.08 ms. Eight unit periods each comprising reset period S1 and address period S2, are assigned for a rest of duration of about 12 ms.

The reset period S1 is 50 μs in each sub-field SF. Moreover, a time of 3 μs is required for the address cycle (scan per a line). Therefore, if the panel has 480 display lines in the vertical direction, a time of 1.44 ms (3×480) is necessary.

In the above-mentioned conventional AC-type plasma display device (PDP), a frame that forms a screen is constituted by several subframes (SF) having different degrees of brightness to effect the gradation display.

In setting a voltage, when a final subframe SF is turned on in a given frame, the cell 3 of the subframe that should be turned on first in the next frame may not be properly displayed. This inconvenience is hereinafter called half tone noise, and its pattern of generation is shown in FIG. 8(*a*).

That is, referring to FIG. 8(*a*), the state where noise is generated is illustrated by using a pattern for selectively turning on the three kinds of subframes shown in FIG. 8(*a*) under the condition where one frame is constituted by four subframes SF1 to SF4, the first frame is displayed and, then, the second frame is displayed.

As a result, it was found that when the subframe 4 just before the quiescent period S4 in the first frame is turned on, the subframe that is turned on first in the succeeding second frame generates half-tone noise as in the pattern a and in the pattern b described in the comments column of FIG. 8(*b*).

That is, in the pattern a, the subframe SF4 in the first frame just before the quiescent period S4 is turned on causes the subframe SF1 that is turned on first in the second frame to generate half tone noise. In the pattern b, the subframe SF4 in the first frame just before the quiescent period S4 is turned on causes the subframe SF3 that is turned on first in the second frame to generate half tone noise.

In the pattern c, on the other hand, the subframe SF4 in the first frame just before the quiescent period S4 is not turned on, and the subframe SF1 that is turned on first in the second frame does not generate half tone noise.

In FIG. 8(*a*), the lateral bar (–) means that the subframe SF is the one that is not turned on.

From the results discussed above, it can be considered that in the above-mentioned plasma display device, the subframe SF4 is turned on and, hence, a large amount of wall charge used in the sustain discharge is held in the cell 3 during the quiescent period S4 resulting in the occurrence of half tone noise irrespective of the number of times of sustain discharge of the final subframe SF4 and, accordingly, the cell of the SF that is turned on first in the next frame is no longer capable of effecting normal address discharge and normal sustain discharge.

When the final subframe SF4 is not turned on, contrary to the above, no wall charge is held in the cell 3 during the quiescent period S4, and the half tone noise is not generated.

The object of the present invention is to provide a plasma display device which is capable of displaying a high quality picture without generating half tone noise in the succeeding frames irrespective of the arrangement or the turned-on state of the subframes in a preceding frame that is displayed, by removing defects inherent in the above-mentioned prior art.

SUMMARY OF THE INVENTION

In order to accomplish the above-mentioned object, the present invention employs a technical constitution that is described below.

That is, a first embodiment of the present invention is concerned with a plasma display device in which a picture of a frame is gradation-displayed on a display device relying upon a plurality of selective combinations having different degrees of brightness, each of the plurality of subframes including at least an address period and a sustain discharge period, characterized in that a discharge waveform-imparting period for effecting the sustain discharge is provided between a quiescent period, which is determined by a difference between the sum of a series of drive periods in a predetermined frame and a vertical synchronizing period, and said address period in a subframe at the head of a succeeding frame. A second embodiment is concerned with a plasma display device in which a picture of a frame is gradation-displayed on a display device relying upon a plurality of selective combinations having different degrees of brightness, each of the plurality of subframes including at least an address period and a sustain discharge period, characterized in that a wall charge-erasing voltage for erasing the charge voltage after the completion of the sustain discharge is applied to a discharge electrode during an interval between a sustain discharge period in a final subframe in a predetermined frame and a quiescent period which is determined by a difference between the sum of a series of drive periods in said predetermined frame and a vertical synchronizing period.

A third embodiment is concerned with a plasma display device in which a picture of a frame is gradation-displayed on a display device relying upon a plurality of selective combinations having different degrees of brightness, each of the plurality of subframes including at least an address period and a sustain discharge period, characterized in that the order of the subframes constituting the frame is so rearranged that among said subframes, a subframe having the smallest display factor is arranged as the final subframe in said frame.

A fourth embodiment of the present invention is concerned with a plasma display device in which a picture of a frame is gradation-displayed on a display device relying upon a plurality of selective combinations having different degrees of brightness, each of the plurality of subframes including at least an address period and a sustain discharge period, characterized in that the subframes that are all turned on are detected in a predetermined frame, and the order of the subframes is so rearranged that among the subframes having display factors larger than a predetermined value, a subframe having the smallest degree of brightness is arranged at the head of a next frame neighboring said frame.

A fifth embodiment of the present invention is concerned with a plasma display device in which a picture of a frame is gradation-displayed on a display device relying upon a plurality of selective combinations having different degrees of brightness, each of the plurality of subframes including at least an address period and a sustain discharge period, characterized in that a quiescent period which is determined by a difference between the sum of a series of drive periods in a predetermined frame and a vertical synchronizing period, is provided between the reset period and the address period in a predetermined subframe.

Furthermore, a sixth embodiment is concerned with a plasma display device in which a picture of a frame is gradation-displayed on a display device relying upon a plurality of selective combinations having different degrees of brightness, each of the plurality of subframes including at least an address period and a sustain discharge period, characterized in that a quiescent period which is determined by a difference between the sum of a series of drive periods in a predetermined frame and a vertical synchronizing period, is provided between the address period and the sustain discharge period in a predetermined subframe.

The plasma display device according to the present invention employs a technical constitution according to various embodiments mentioned above. In the plasma display device according to the first embodiment, the quiescent period S4 is sandwiched between the sustain discharge period S3 in the subframe SF4 that is finally turned on in the preceding first frame that is displayed and the reset period S1 of the subframe SF1 that is turned on first in the succeeding second frame, in order to substantially eliminate the quiescent period. Since the subframes are so turned on that the wall charge is not held during the quiescent period, it is made possible to prevent the occurrence of half tone noise that is caused by a large amount of wall charge that is held in the cell portion 3 during the quiescent period S4.

According to the plasma display device of the present invention, it is possible to prevent or decrease the mis-address discharge and the mis-sustain discharge of the turned-on cell 3 that is caused by the quiescent period S4, and the display quality of the PDP can be markedly improved.

According to the second embodiment of the present invention, the half tone noise is prevented from occurring by outputting a waveform for erasing the wall charge prior to entering into the quiescent period. According to the third embodiment of the present invention, the final subframe in the predetermined frame is not turned on as much as possible, the display factors of a plurality of subframes constituting the frame are detected, a subframe having the smallest degree of brightness among the subframes having display factors of larger than a predetermined value is arranged as the final subframe, and the wall charge is prevented from accumulating as much as possible to suppress the occurrence of half tone noise. According to the fourth embodiment, furthermore, when the subframes in the preceding frame are all turned on, a subframe having the smallest display factor is arranged as the subframe at the head of the next frame. Even when the half tone noise is generated, therefore, any adverse effect or damage is minimized.

According to the fifth and sixth embodiments of the present invention, furthermore, the quiescent period interposed between the sustain discharge period and the reset period in the next frame, which is a problem, is shifted to be positioned between the reset period and the address period or is shifted to be positioned between the address period and the sustain discharge period, in order to substantially abolish the quiescent period interposed between the sustain discharge period and the reset period in the next frame. This makes it possible to avoid the state where a large amount of wall charge is held in the quiescent period after the sustain discharge period and to prevent the half tone noise from occurring.

BRIEF DESCRIPTION OF THE DRAWINGS

FIG. 19 is a diagram illustrating a case when the arrangement of subframes is changed depending upon the number of display cells in driving the plasma display device of the present invention.

DETAILED DESCRIPTION OF THE PREFERRED EMBODIMENTS

Embodiments of the plasma display device according to the present invention will now be described in detail with reference to the drawings.

Though the following embodiments of the present invention are concerned with a method which totally writes and totally erases data during the reset period S1, it should be noted that the present invention is in no way limited to the above embodiments only.

Figure 7A:
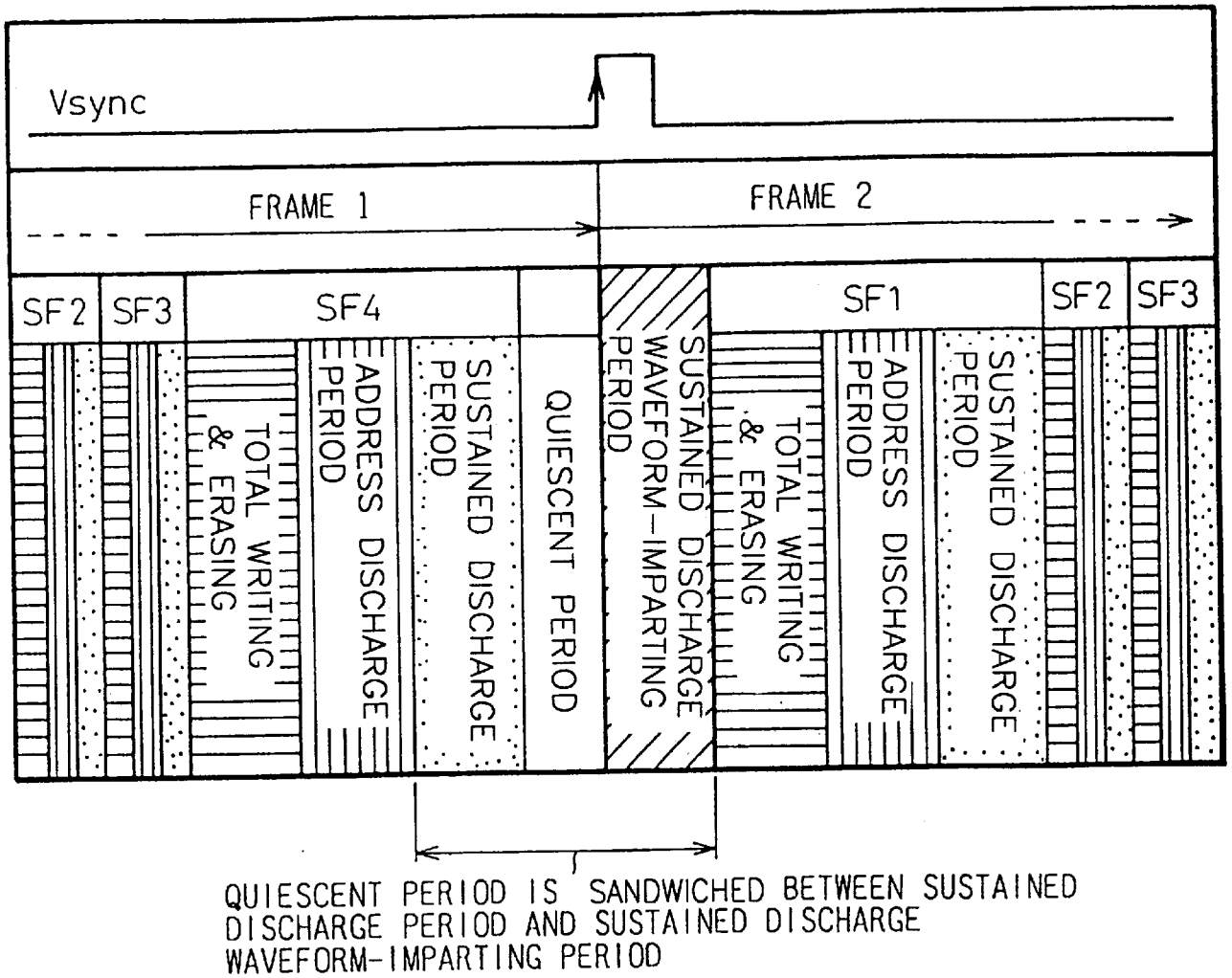
FIG. 7(*a*) is a diagram illustrating a drive sequence of the plasma display device according to the present invention, and FIG. 7(*b*) is a diagram illustrating another drive sequence of the plasma display device according to the present invention.
Figure 7B:
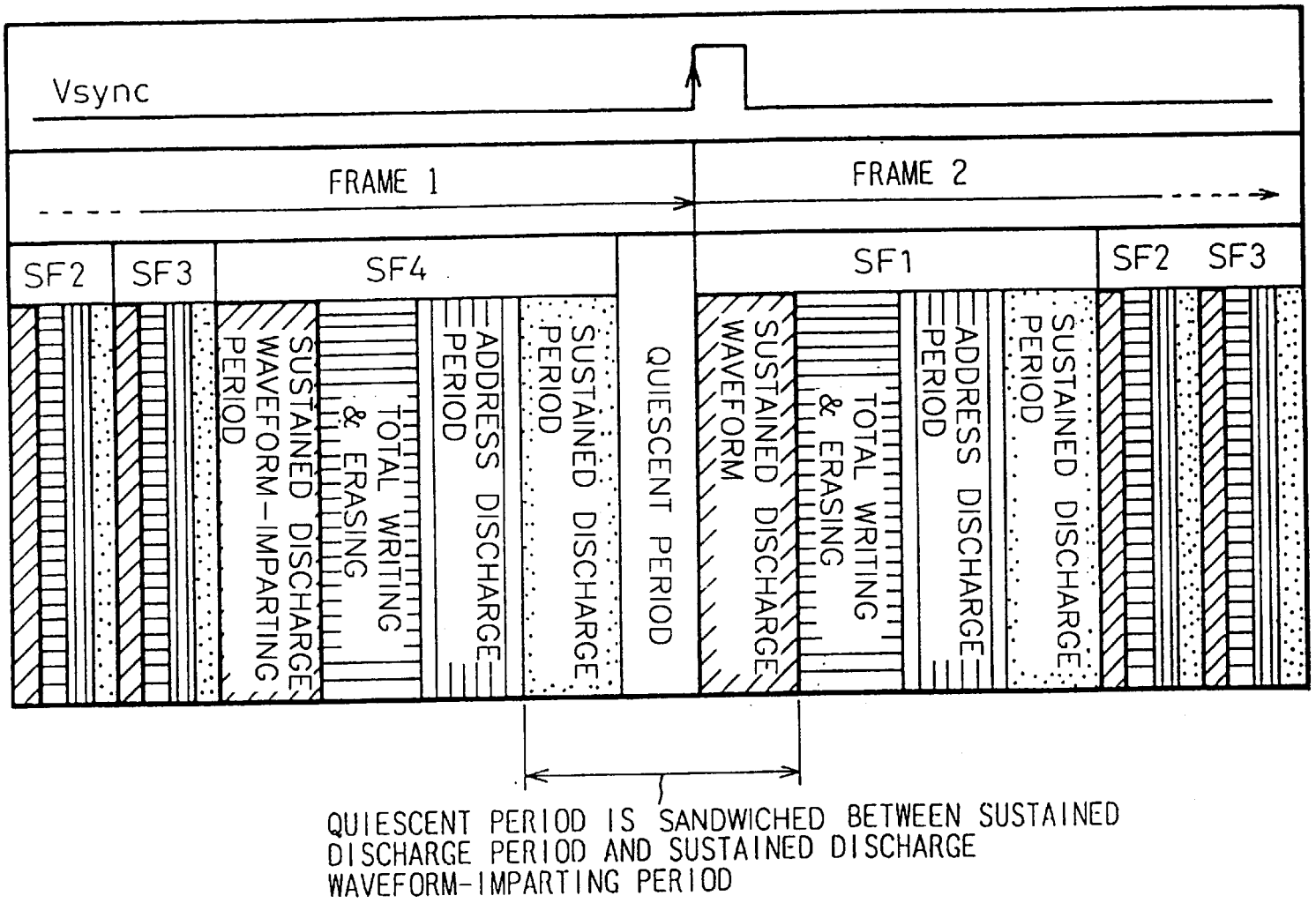

According to the first embodiment of the present invention, the plasma display device 1 has a constitution in which, when a picture of a frame is displayed on a display device 1 while changing the gradation by combining a plurality of subframes SF1 to SFn having different degrees of brightness, each of the plurality of subframes SP1 to SFn is constituted by at least a totally writing and totally self-erasing period S1, an address period S2, a sustain discharge period S3, and a quiescent period S4 determined by a difference between the sum of the periods S1 to S3 and a period of a vertical synchronizing signal Vsync, and each of the plurality of subframes SF1 to SFn has the sustain discharge period S3 which can be so varied as to exhibit an independent brightness wherein, as shown in FIG. 7(*a*), a period S5 for imparting a discharge waveform different from the sustain discharge waveform applied across the electrodes is provided in the sustain discharge period S3 between the quiescent period S4 in the predetermined frame FM1 and the totally writing and totally self-erasing period S1 in the succeeding frame FM2.

That is, in the present invention as described above, it is assumed that the half tone noise is caused by the large amount of wall charge that is used by the sustain discharge in the final subframe SF4 in the frame and that is held in the cell portion 3 during the quiescent period S4. In order to solve such a problem, therefore, a period S5 is provided after the completion of the quiescent period S4 to impart a discharge waveform which is different from the sustain discharge waveform applied during the sustain discharge period S3, and the quiescent period is sandwiched between the sustain discharge waveform and the discharge waveform. Thus, the quiescent period which was a problem is substantially eliminated and the half tone noise is prevented from occurring. To described in further detail, the above-mentioned period S5 for imparting the discharge waveform is provided immediately after the quiescent period S4 that exists between the sustain discharge period S3 in the subframe SF4 that is finally turned on in the first preceding frame FM1 that is displayed and the totally writing and totally self-erasing period S1 in the subframe SF1 that is turned on first in the succeeding second frame FM2. Then, the discharge waveform is applied across the electrodes of the cell portion 3, in order to avoid a state in which a quiescent period S4 exists between the sustain discharge period S3 in the subframe SF4 that is turned on last in the first preceding frame FM1 that is displayed and the totally writing and totally self-erasing period S1 in the subframe SF1 that is turned on first in the succeeding second frame FM2.

Figure 8B:
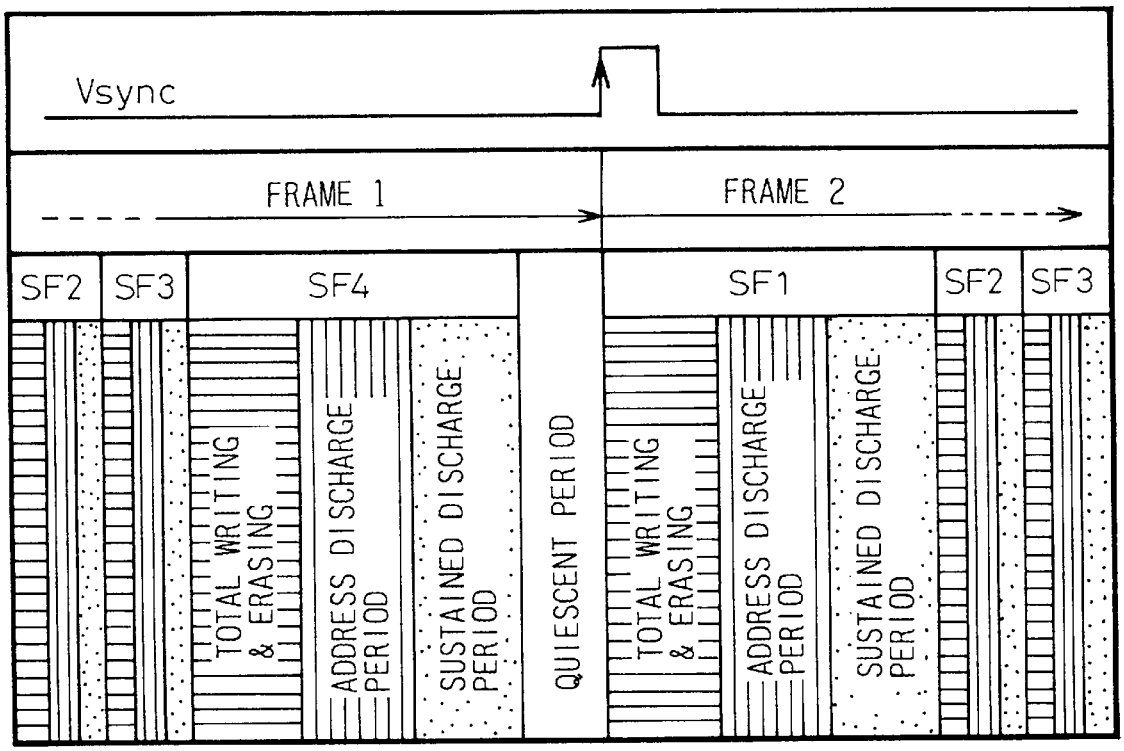
FIG. 8(*a*) is a diagram explaining the cause of half tone noise that is generated in the conventional plasma display device, and FIG. 8(*b*) is a diagram explaining a drive sequence in the conventional plasma display device.

FIG. 8(*b*) is a time chart of the type of address/sustain discharge separation illustrating in detail, according to a prior art, the display method using the plasma display device of the first embodiment of the present invention, and FIG. 7(*b*) is a time chart illustrating the same display method according to the present invention.

If described in comparison with the display method using the conventional plasma display device, the plasma display device of FIG. 8(*b*) contains a quiescent period S4 that exists between the sustain discharge period S3 in the subframe SF4 that is turned on last in the first preceding frame FM1 that is displayed and the totally writing and totally self-erasing period S1 in the subframe SF1 that is turned on first in the succeeding second frame FM2, and hence involves a problem in that half tone noise is generated as described earlier. In the plasma display device according to the first embodiment of the present invention as shown in FIG. 7(*a*), on the other hand, the period 5 for imparting the discharge waveform is provided between the quiescent period S4 in the first preceding frame FM1 and the totally writing and totally self-erasing period S1 in the subframe SF1 at the head of the succeeding second frame FM2.

In the drawings, the upper limit and lower limit of a period of a vertical synchronizing signal Vsync have generally been set but it will be different from each other depending upon the interface used by the user.

Therefore, the quiescent period S4 corresponds to a difference of time between the vertical synchronizing signal Vsync and the period in each subframe SF becomes indefinite. In order to sandwich the quiescent period S4 which is indefinite between the sustain discharge waveform and the discharge waveform, the discharge waveform should be output during the period of imparting the discharge waveform simultaneously with the arrival of a trigger signal of Vsync as shown in FIG. 7(*a*). Then, the quiescent period S4 is incorporated in the sustain discharge period S3 and is substantially eliminated from the point of view that the quiescent period S4 is a cause of half tone noise.

Figure 4:
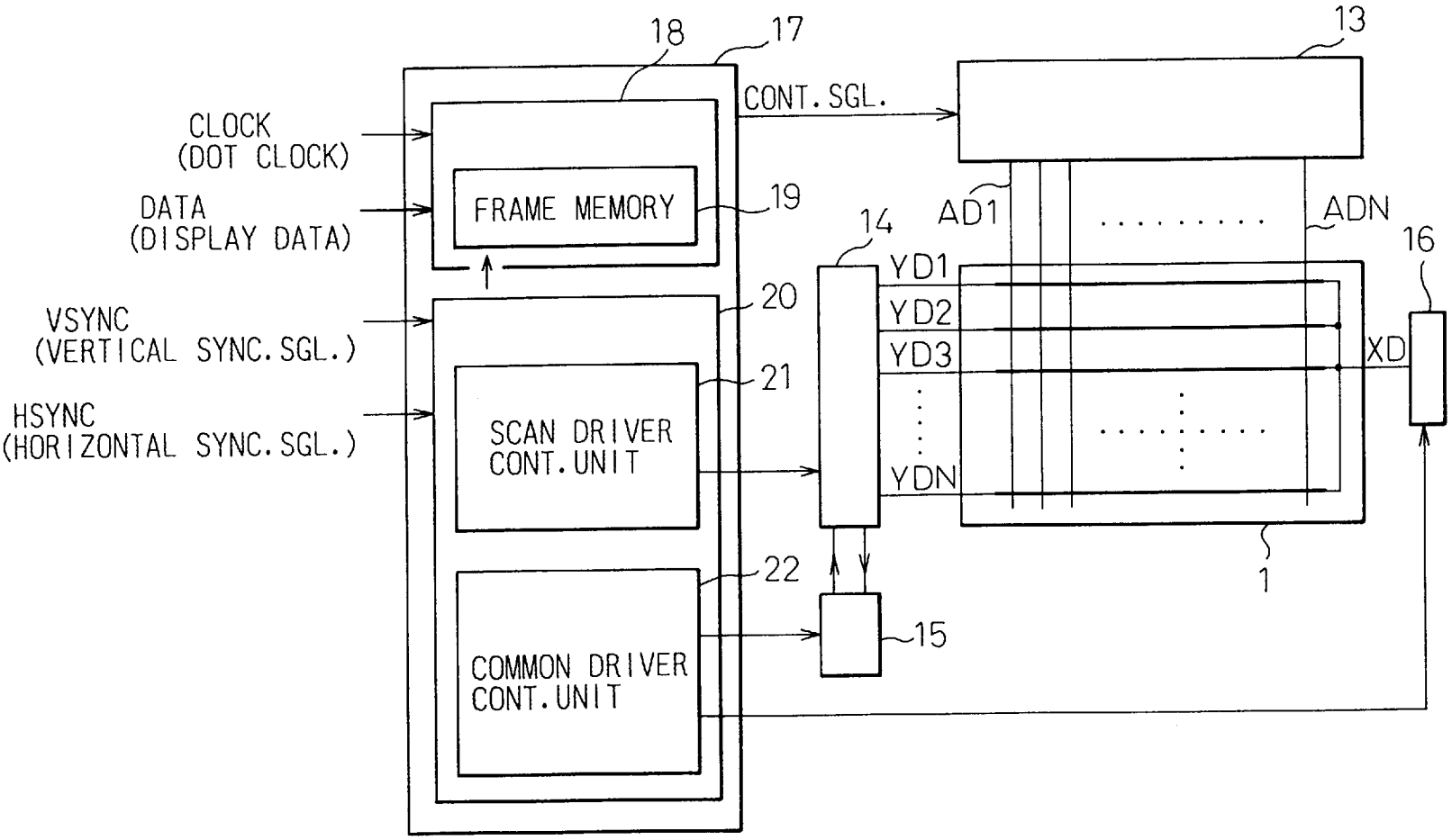
FIG. 4 is a block diagram which schematically illustrates the peripheral circuits for driving the plasma display device used in the present invention.
Figure 9:
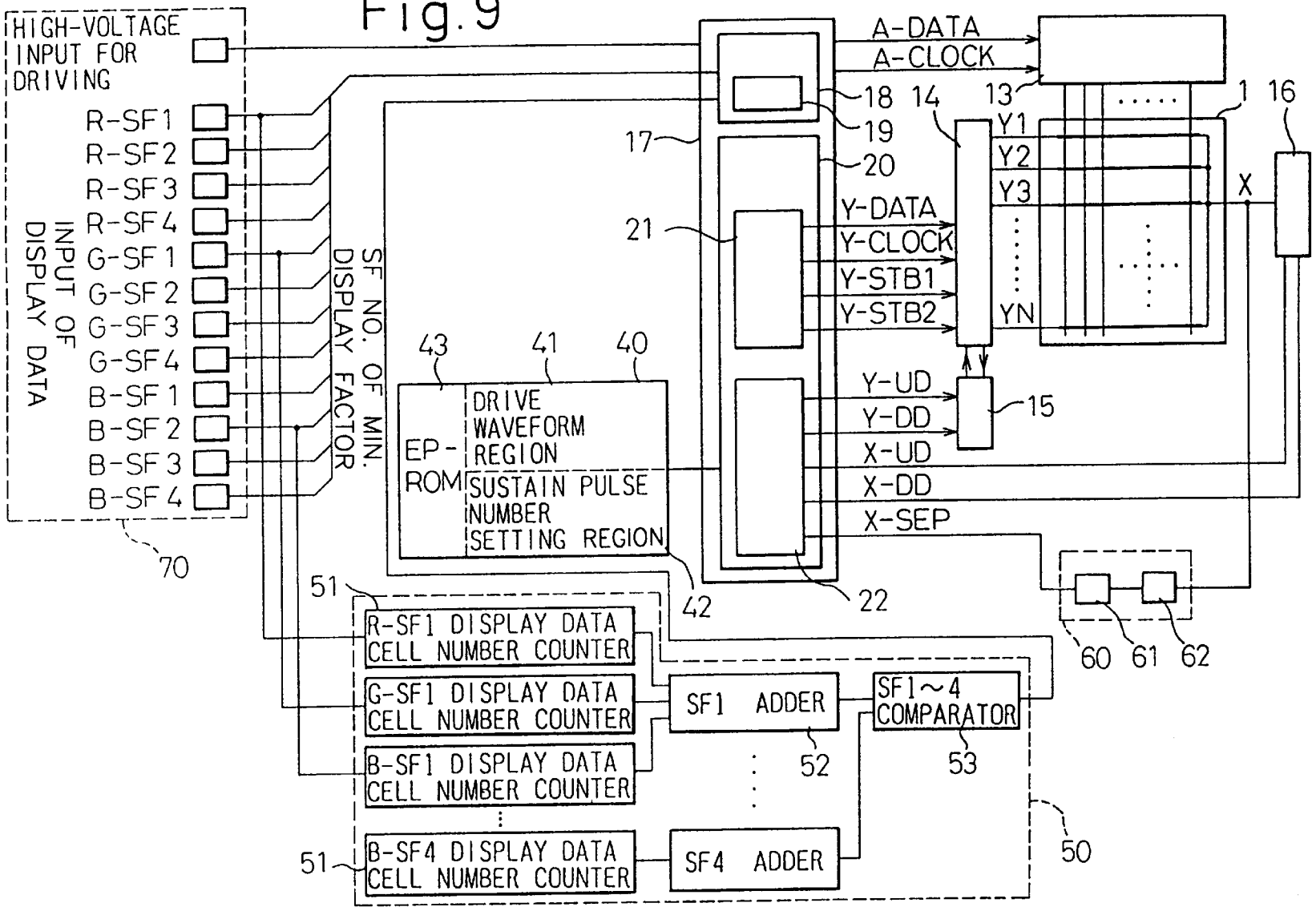
FIG. 9 is a block diagram of a circuit constitution in which a control circuit is added to the plasma display device of the present invention.

This embodiment can be put into practice by adding a programmable ROM 40, as shown in FIG. 9, to a drive control main circuit of the plasma display device 1 of the present invention shown in FIG. 4.

The programmable ROM 40 can be constituted, for example, by an EP-ROM 43 that has a drive waveform region 41 and a sustain pulse number setting region 42.

That is, in this embodiment, since the EP-ROM 43 stores the drive waveform, the embodiment can be realized by rewriting the EP-ROM.

On the other hand, it has been experimentally confirmed that the discharge waveform that is used during the discharge waveform-imparting period exhibits sufficient effect to the half tone noise even when it is used in a small number of from one to several sets.

Figure 5:
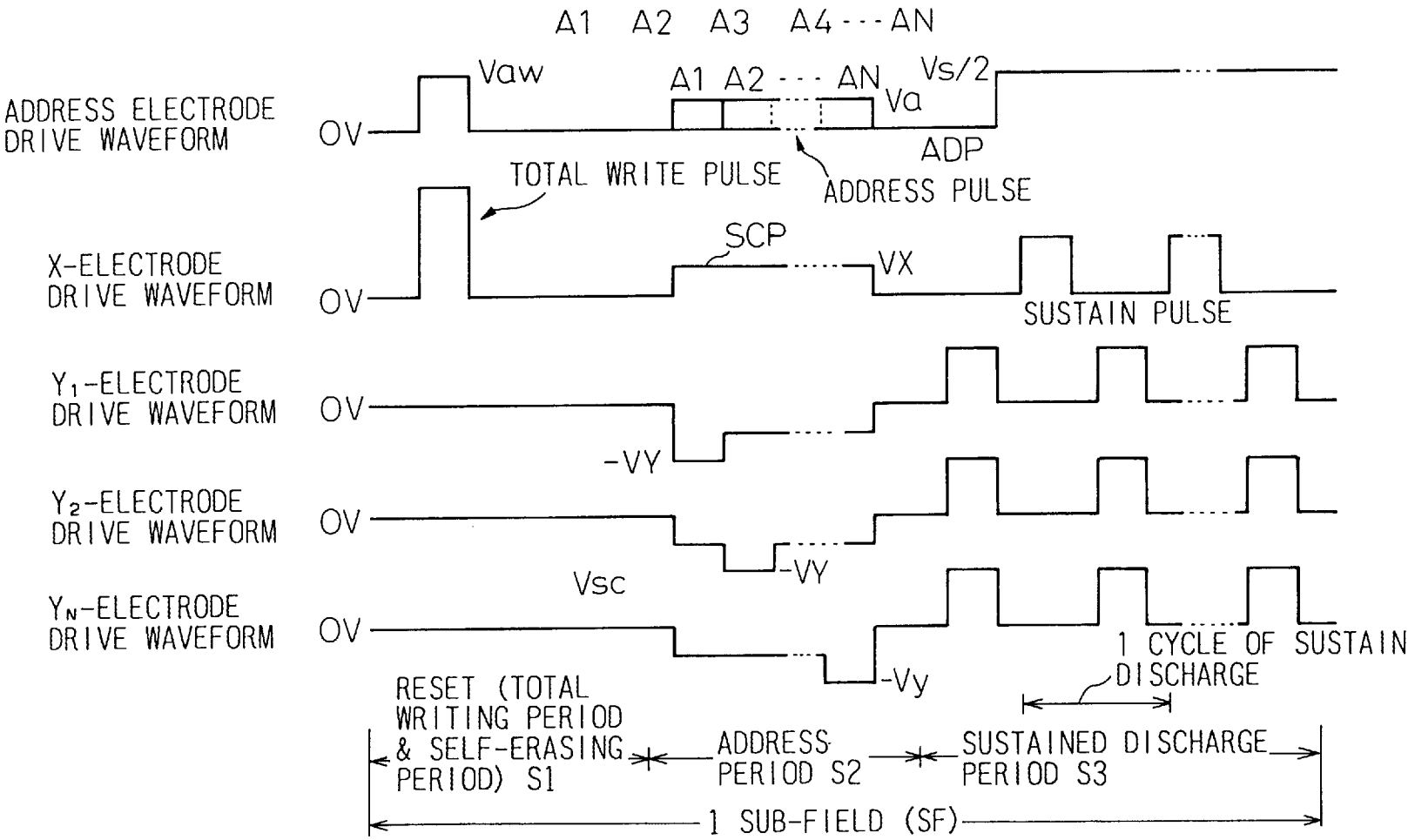
FIG. 5 is a diagram of waveforms for explaining the method of driving a plasma display device according to a prior art.
Figure 6:
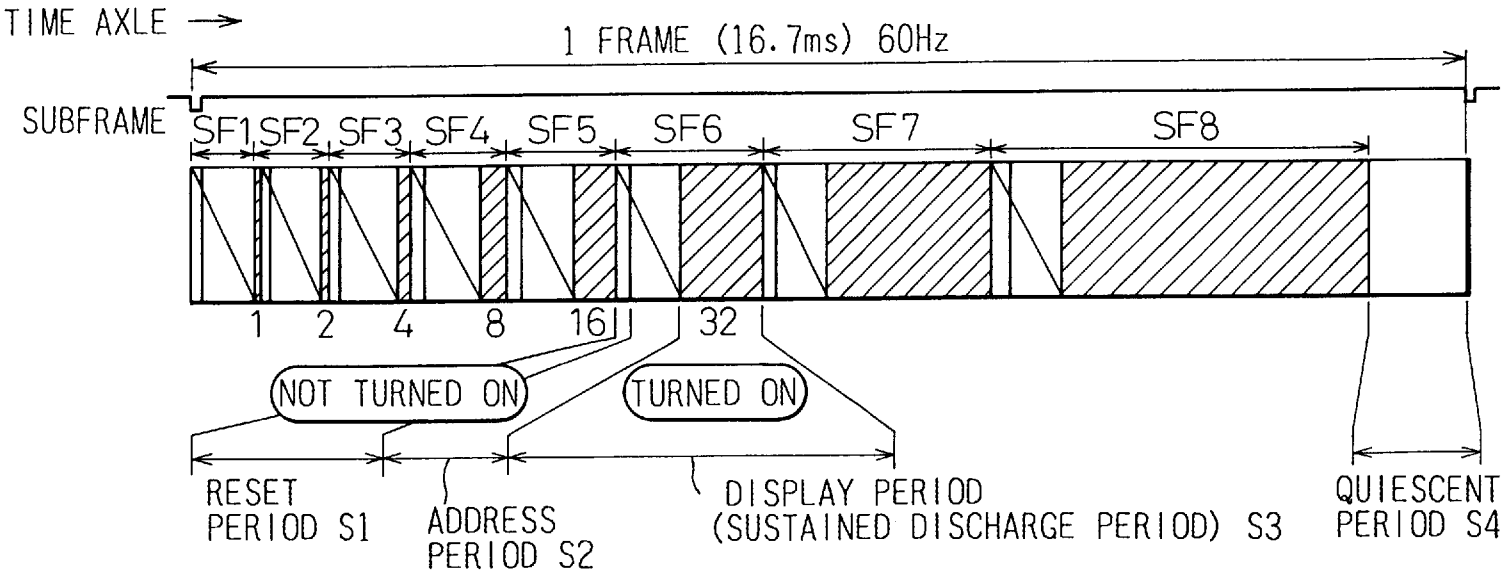
FIG. 6 is a diagram of a time chart in a conventional plasma display device.

As far as the plasma display device 1 of the present invention effects the sustain discharge by utilizing the effect of storing the wall charge, pulses are alternately applied to the X-electrode XD and to the Y-electrodes YD1 to YDn as shown in FIG. 5. Here, a set of sustain discharge pulses stand for a total of two pulses, i.e., one pulse for the X-electrodes XD and one pulse for the Y-electrodes YD1 to YDn.

That is, in the period S5 for imparting the discharge waveform according to the first embodiment of the present invention, it is desired that at least one discharge waveform is used and that the discharge waveform is applied to either the X-electrode or the Y-electrode arranged in the plasma display device.

In this embodiment, furthermore, it is desired that the discharge waveform is constituted by a set of waveforms which are applied to at least the X-electrode and the Y-electrode arranged in the plasma display device.

In this embodiment as shown in FIG. 7(*a*), furthermore, the four subframes SF1 to SF4 that are selectively used in the frame are each constituted by three blocks consisting of the totally writing and erasing period S1, address period S2 and sustain discharge period S3. Among them, the totally writing and erasing period S1 and the address period S2 have the same lengths in each of the subframes SF, and the sustain discharge periods S3 have a ratio, in the case of four subframes SF1 to SP4, of nearly 1:2:4:8.

In the practical drive, therefore, difference of the subframes SF is discerned relying only upon the number of pulses of the sustain discharge waveform. In this case, it may become difficult to substantially remove the quiescent period from each of the frames by simply providing a particular subframe SF with a period for imparting the discharge waveform.

Therefore, in another example of the first embodiment of the present invention, as shown in FIG. 7(*b*), a period for imparting the discharge waveform is provided at the head of each of the plurality of subframes SF constituting the frame, and a predetermined discharge waveform is applied thereto.

That is, in another example according to the first embodiment of the present invention, it is desired that a period for imparting the discharge waveform is provided at the head position of each of the subframes.

According to this method, the quiescent period S4 is sandwiched between the sustain discharge waveform and the sustain discharge waveform for countermeasure in the same manner as that of the aforementioned constitution, and half tone noise is prevented from occurring.

In the plasma display device according to the above-mentioned first embodiment of the present invention, a small number of discharge waveforms, i.e., one to several sets of discharge waveforms are applied across the electrodes in accordance with the above-mentioned method in order to eliminate half tone noise. This embodiment, however, is accompanied by a side effect in that the subframe SFn to which the discharge waveform is added during the discharge waveform-imparting period exhibits an increased brightness.

Though this adverse effect hardly affects the picture in a very bright subframe SF in which the total number of sustain discharge pulses is several hundred, the effect is large in a dim subframe SF in which the total number of pulses is small.

Therefore, the number of sustain discharge pulses must be set to a value from which is subtracted the number of discharge pulses of the discharge waveform imparted during the discharge waveform-imparting period. In this embodiment, since the number of sustain discharge pulses of each subframe SF has been specified by the EP-ROM 43 in the programmable ROM 40 in the circuit constitution shown in FIG. 9, the number of sustain discharge pulses can be changed by rewriting the EP-ROM.

Figures 10, 11:
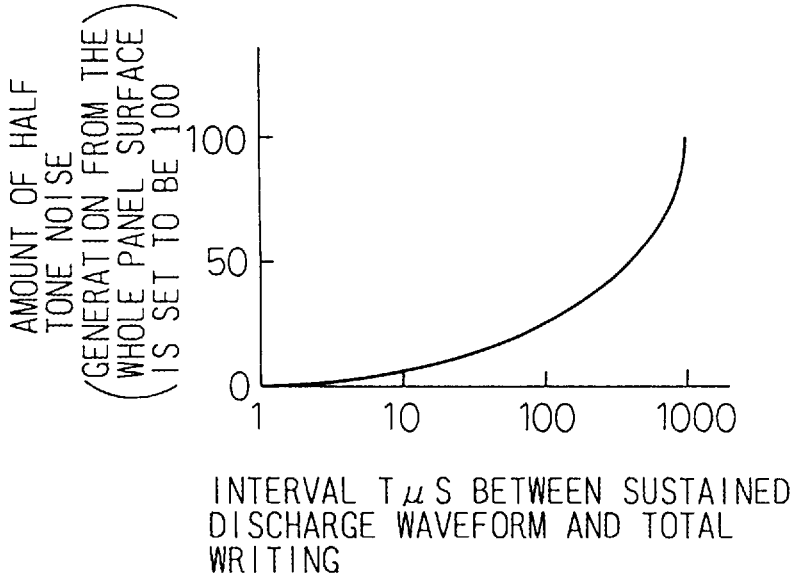
FIG. 10 is a diagram illustrating an example of setting the number of sets of sustain discharge pulses in the subframes in a frame and of changing the setting.
FIG. 11 is a graph illustrating the relationship between the half tone noise and the interval between the discharge waveform and the total writing waveform used in the present invention.

FIG. 10 shows the numbers of sustain discharge pulses of the subframes SF1 to SFn used during the sustain discharge period S3 before being changed in comparison with the numbers of sustain discharge pulses of the subframes SF1 to SFn after being changed when one or one set of discharge waveform pulses are applied to the electrodes of the cell portion 3 during the discharge waveform-imparting period S5 according to this embodiment.

As will be obvious from FIG. 10, when one set of discharge waveform pulses are imparted during the discharge waveform-imparting period, the number of sets of sustain discharge pulses after being changed is equal to the number of sets of pulses obtained by subtracting 1 from the numbers of sustain discharge pulses applied to the subframes SF1 to SFn before being changed.

When the number of sets of sustain discharge pulses is 1 as represented by the subframe SF1 of FIG. 10, furthermore, the number after being changed must be set to zero. In practice, however, the control circuit 17 in the plasma display device of the present invention shown in FIG. 9 must be so controlled that it will not output the sustain discharge pulse when the number of sets of sustain discharge pulses is zero.

That is, according to another example of the first embodiment of the present invention, the number of times of sustain discharge during the sustain discharge period S3 in the subframes SF1 to SFn should desirably be decreased by a number of times that corresponds to the number of discharge waveform pulses imparted during the discharge waveform-imparting period S5.

In the plasma display device according to the present invention, on the other hand, the half tone noise is removed by providing the discharge waveform-imparting period S5 and by arranging the discharge waveform before the totally writing waveform in the totally writing and totally self-erasing period S1 in compliance with the method described above. When the interval between the discharge waveform and the totally writing waveform is too long, however, there takes place a second quiescent period which makes it difficult to obtain the effect to a sufficient degree.

It is therefore desired to keep the interval between the discharge waveform and the totally writing waveform as narrow as is permitted by the electric characteristics of the related elements.

That is, according to a further example of the first embodiment of the present invention, it is desired to set as short as possible the interval between the discharge waveform imparted during the discharge waveform-imparting period S5 and the totally writing/self-erasing waveform in the totally writing and totally self-erasing period S1 that follows the discharge waveform-imparting period S5.

Concretely speaking, FIG. 11 illustrates a relationship between the amount of half tone noise that is generated and the interval T ($\mu$s) between the discharge waveform-imparting period 5 and the totally writing and totally self-erasing period S1. Generation of the half tone noise is suppressed as the interval T ($\mu$s) becomes narrow. It will be understood that ideally the interval T should be set to be shorter than 5 $\mu$s.

Therefore, the interval between the discharge waveform imparted during the discharge waveform-imparting period S5 and the waveform imparted during the totally writing and totally self-erasing period S1 should not be excessively broadened but should desirably be set to be 5 $\mu$s or shorter.

Figure 12A:
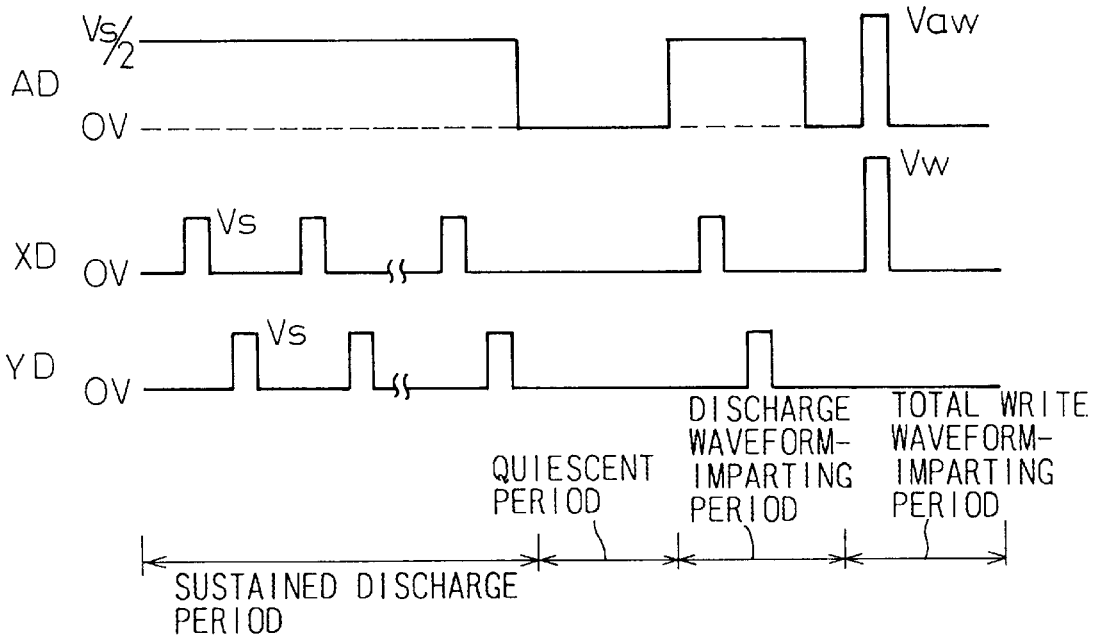
FIG. 12(*a*) is a timing chart for explaining the discharge waveform used in the present invention, and FIG. 12(*b*) is a timing chart for explaining another discharge waveform used in the present invention.
Figure 12B:
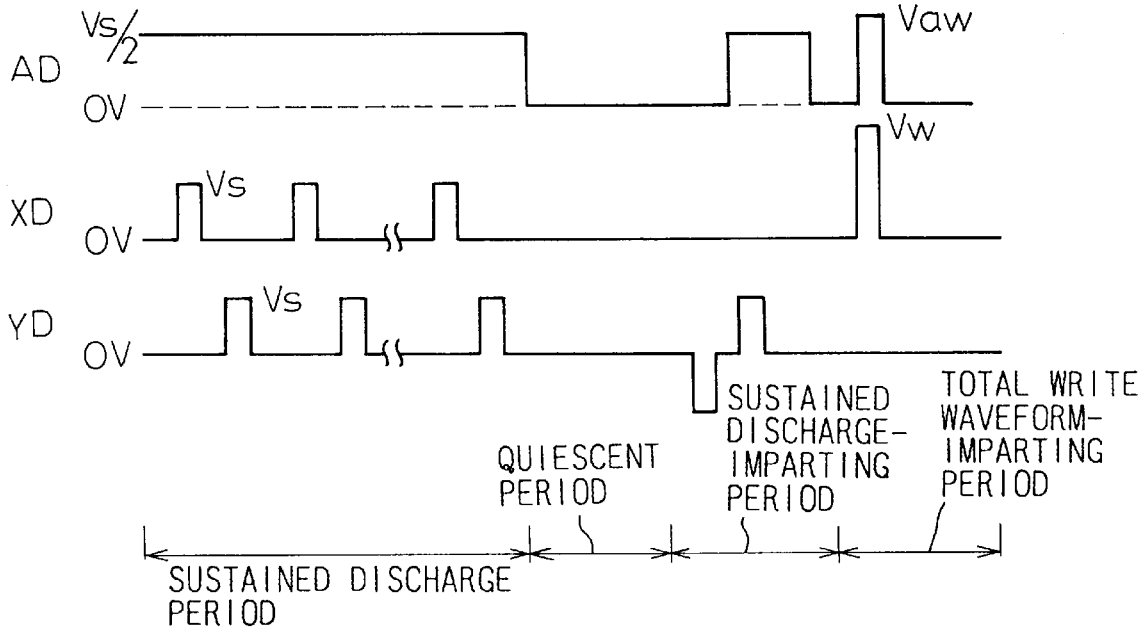

FIGS. 12(*a*) and 12(*b*) illustrate examples of the discharge waveform imparted during the discharge waveform-imparting period S5.

In FIG. 12(*a*), pulses of the same polarity are alternately applied to the X-electrode and the Y-electrode in the same manner as the main sustain discharge waveform is applied in compliance with the aforementioned method. In FIG. 12(*b*), on the other hand, pulses of different polarities are alternately applied to the electrode of one side (Y-electrode in the drawing).

In this case, the potential difference between the electrodes X and Y is the same as that of (a), and the same effect is obtained and, besides, the potential difference between the address electrode AD and the Y-electrode YD can be made larger than that of the case of FIG. 12(*a*).

That is, according to a further example of the first embodiment of the present invention, it is desired that the interval is set to be not longer than 5 $\mu$s between the discharge waveform imparted during the discharge waveform-imparting period and the totally writing/self-erasing waveform imparted during the succeeding totally writing and totally self-erasing period. It is further desired that the discharge waveform imparted during the discharge waveform-imparting period is so constituted that voltages of different polarities are alternately applied to either the X-electrode or the Y-electrode arranged in the plasma display device.

In the example of the present invention, it is particularly desired that the discharge waveform imparted during the discharge waveform-imparting period is so constituted as to increase the potential difference between the address electrode and either the X-electrode or the Y-electrode arranged in the plasma display device.

Next, in order to accomplish the aforementioned object, another example of the plasma display device according to the second embodiment of the present invention is described below.

According to the second embodiment of the present invention, generation of the half tone noise is prevented by applying a predetermined voltage waveform to erase the wall charge prior to entering into the quiescent period S4.

In the aforementioned conventional plasma display device, half tone noise is generated due to large amounts of wall charge, used by the sustain discharge in the final SF in the frame, that was stored during the quiescent period. In order to solve this problem, another means can be contrived to positively erase large amounts of wall charge used by the sustain discharge prior to entering into the quiescent period S4.

For this purpose, there can be contrived a method of applying narrow pulses and a method of using pulses having a saw-tooth sloped waveform of which the voltage level changes in a predetermined direction with the passage of time, as will be described below.

Described below are the principles of erasing.

Figure 1:
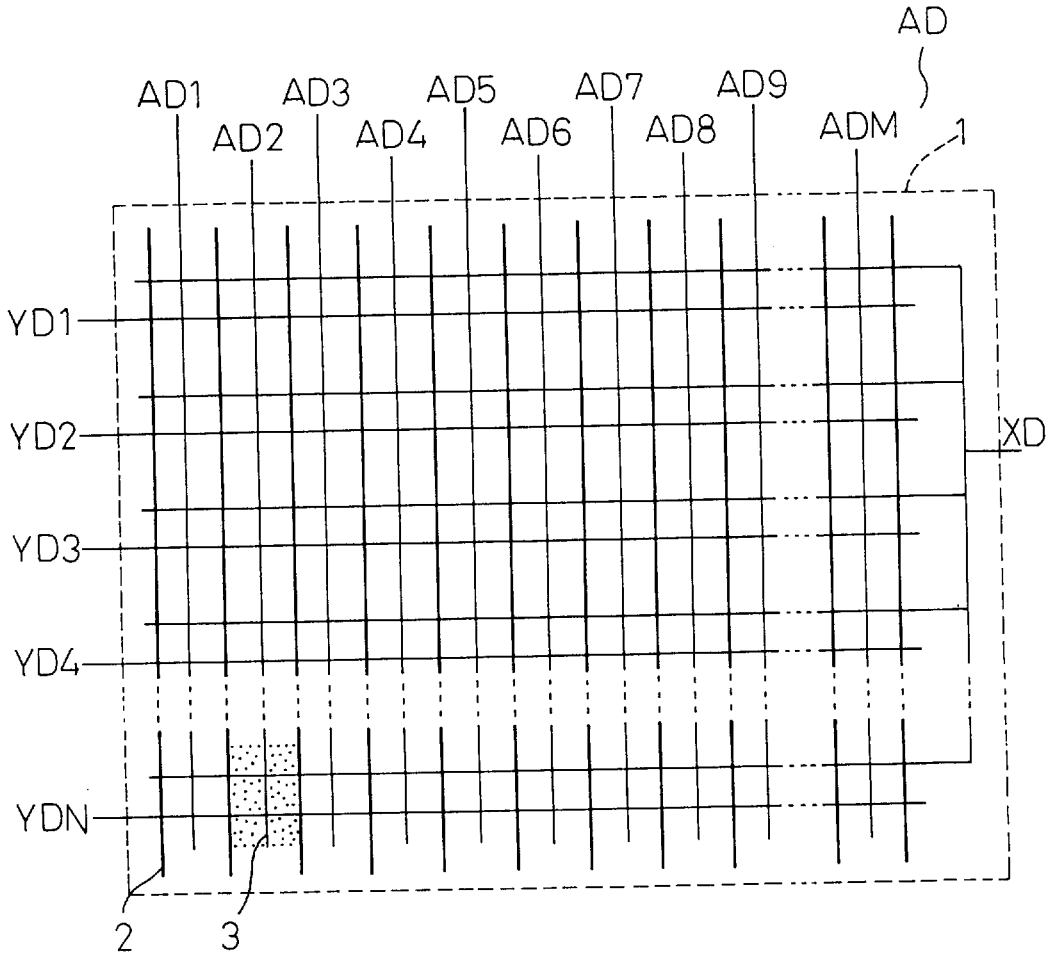
FIG. 1 is a plan view which schematically illustrates a plasma display device used in the present invention, i.e., a plasma display device (PDP) of the three electrode/surface discharge/AC type.
Figure 2:
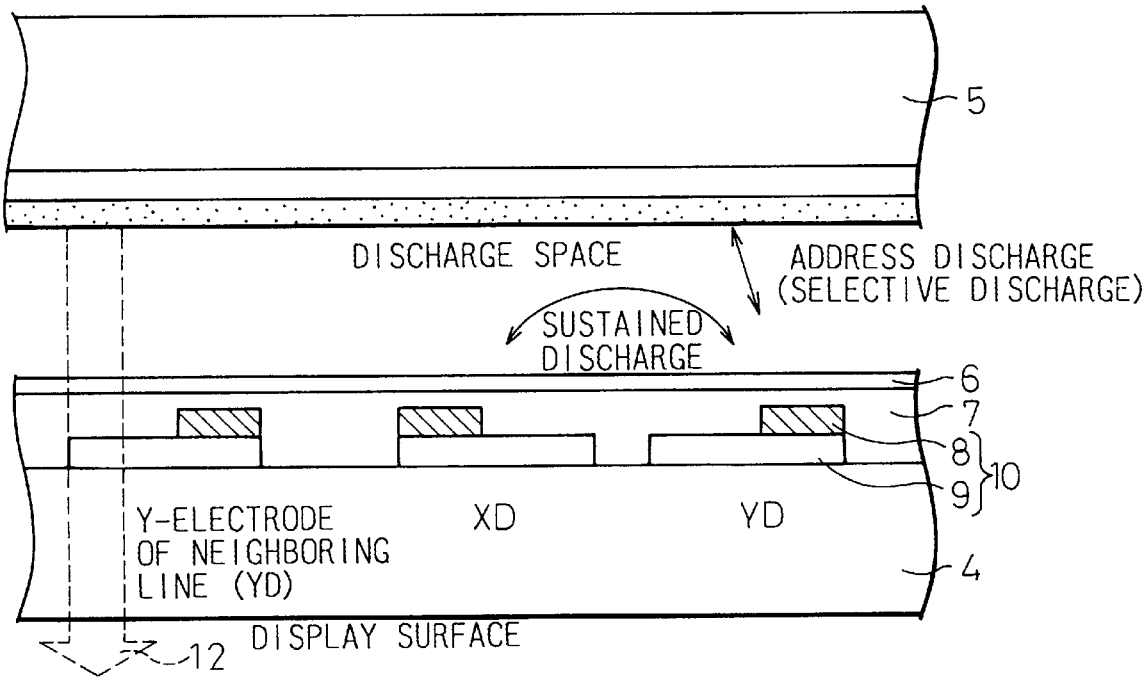
FIG. 2 is a sectional view along the address electrode of the plasma display device shown in FIG. 1 as used in the present invention.
Figure 3:
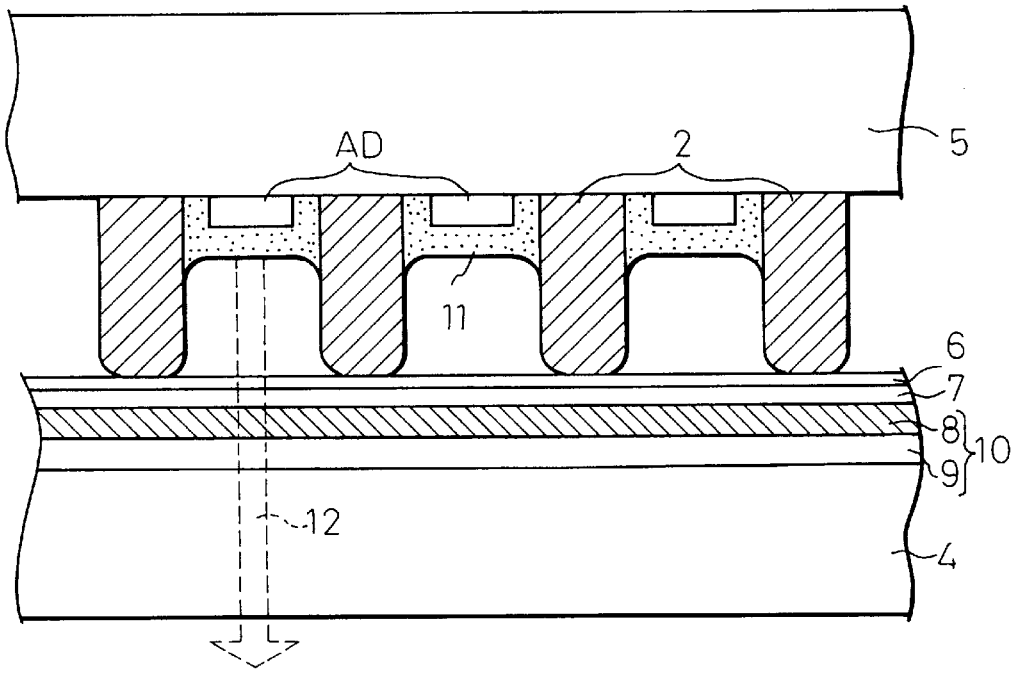
FIG. 3 is a sectional view along the sustain electrode of the plasma display device shown in FIG. 1 as used in the present invention.
Figure 13A:
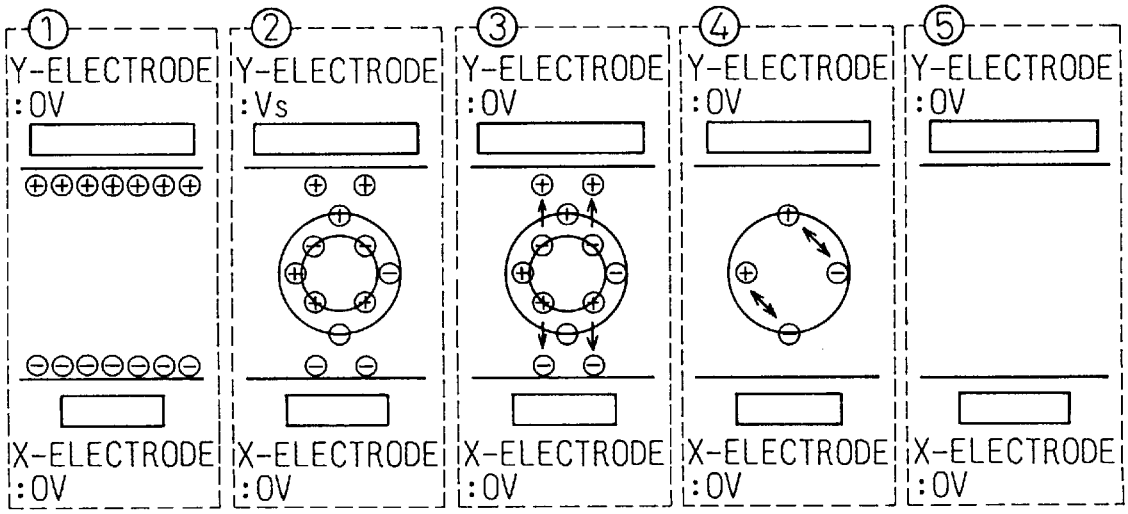
FIG. 13 is a diagram illustrating a principle for erasing the wall charge in the case when a wall charge-erasing waveform is applied in the plasma display device according to the present invention, wherein FIG. 13(*a*) illustrates a case when a narrow pulse is applied and FIG. 13(*b*) illustrates a case when a saw-tooth pulse is applied.
Figure 13B:
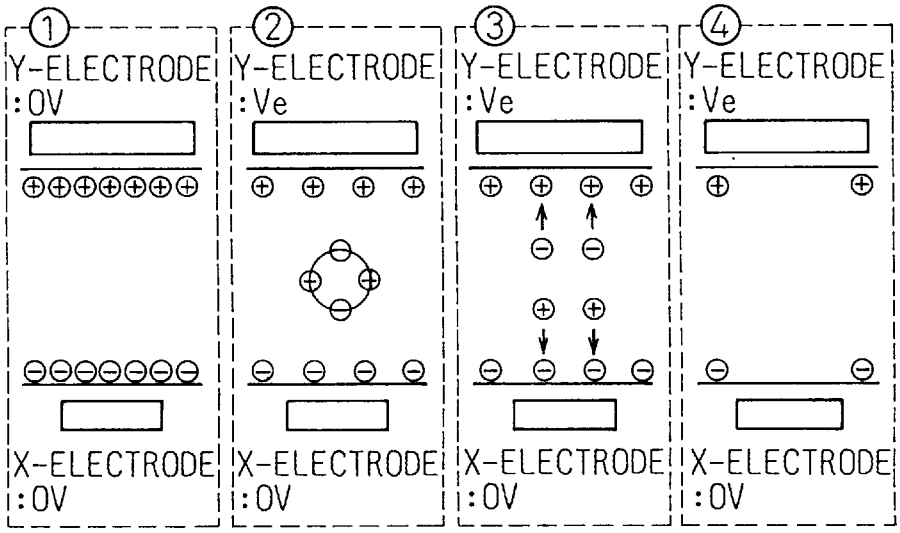
Figures 14A, 14B:
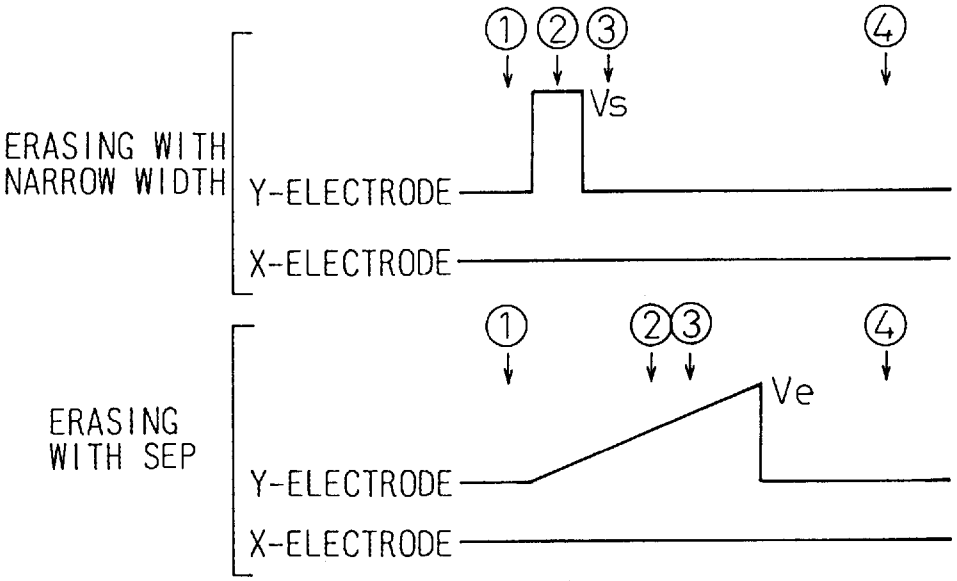
FIG. 14(*a*) is a diagram of a waveform of a narrow pulse used in the present invention, and FIG. 14(*b*) is a diagram of a waveform of a saw-tooth pulse used in the present invention.

FIG. 13(*a*) illustrates changes in the wall charge in the case when a voltage waveform shown in FIG. 14(*a*) is applied to the X-electrode XD and the Y-electrode YD that work as discharge electrodes in the plasma display device 1 of the present invention having the structure as shown in FIGS. 2 or 3.

That is, in FIG. 13(*a*), a pulse voltage having a narrow width is applied to the Y-electrode YD.

In FIG. 13(*a*), a step (1) represents a state where large amounts of wall charge before the narrow pulse is applied are existing on the side of the Y-electrode YD and on the side of the X-electrode XD.

In a step (2), a narrow pulse of about 180 V is added to the voltage of the wall charge in the cell, whereby a potential of about 300 V is formed which exceeds the discharge start potential. Therefore, the discharge takes place.

The step (2) illustrates the state where the discharge is started in the cell 3. The wall charge in the step (1) is decreasing and, instead, charged particles are generated floating in the discharge cell.

A step (3) is illustrating a state immediately after the application of the narrow pulse voltage is discontinued but before the discharge is terminated. The wall charge adhering on the wall surfaces without receiving the action of the discharge is neutralized on the wall surfaces by absorbing charged particles that are floating due to electrostatic force. In a step (4), the floating charged particles recombine together and are neutralized. In a step (5), large amounts of wall charge are erased.

In this example, application of a pulse having a narrow width must be discontinued before the discharge terminates. Therefore, the pulse width should not be longer than 1 $\mu$s.

Figure 15:
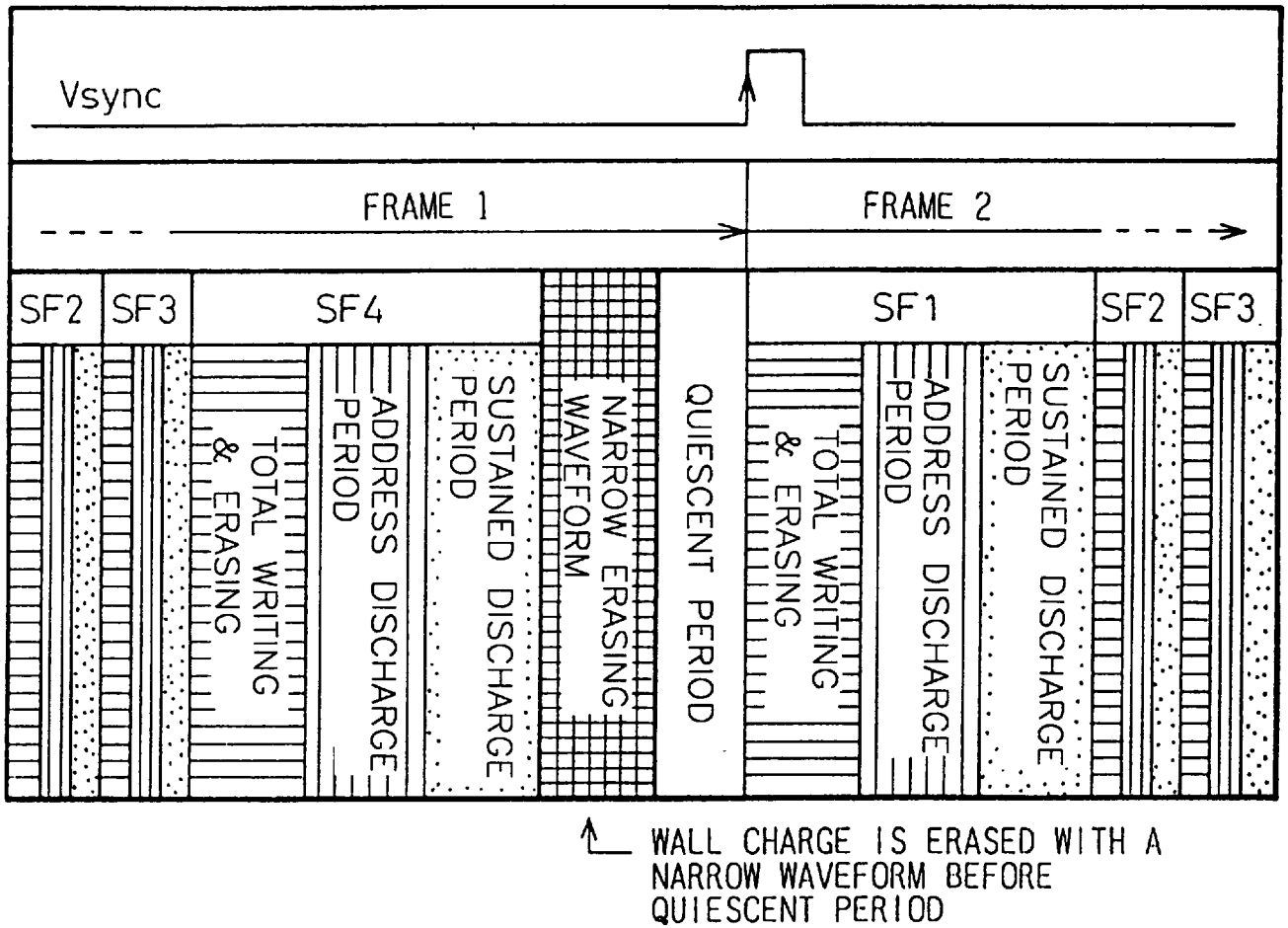
FIG. 15 is a diagram illustrating a drive sequence when a narrow pulse is applied as a wall charge-erasing waveform in the plasma display device of the present invention.

In the present invention, it is desired that the pulse of a narrow width be applied during a period S6 immediately after the completion of the sustain discharge period S3 in the final subframe SF4 in the predetermined frame but just before the start of the quiescent period S4 as shown in FIG. 15.

Relying upon the above-mentioned principle, a narrow pulse is used, just before the quiescent period S4, in order to erase the wall charge before entering into the quiescent period S4, and half tone noise is prevented from occurring.

Figure 16:
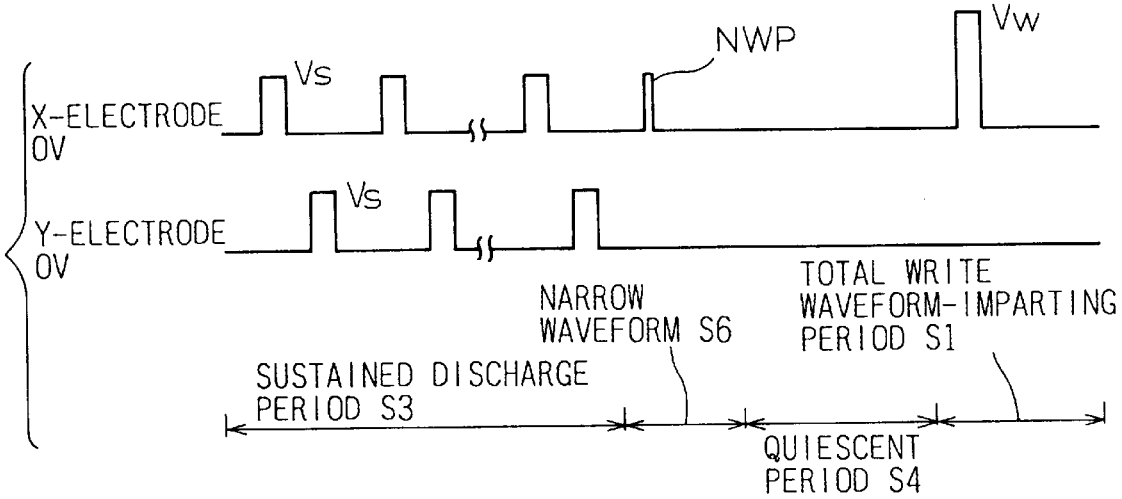
FIG. 16 is a timing chart of a case when a narrow pulse is used as a wall charge-erasing wave in the present invention.
Figure 17:
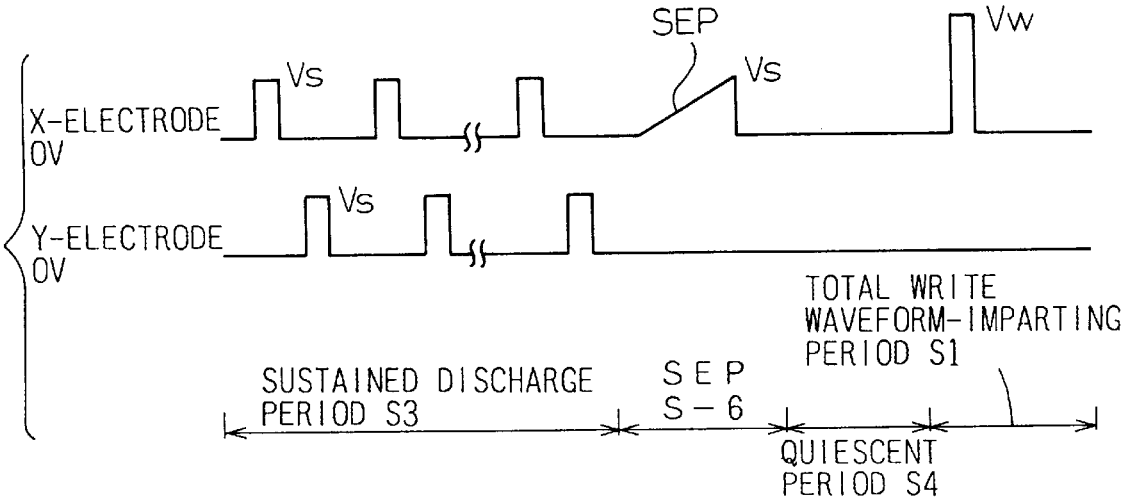
FIG. 17 is a timing chart of a case when a saw-tooth pulse is used as a wall charge-erasing wave in the present invention.

FIG. 16 illustrates an example of using a narrow pulse NWP in this embodiment. In this case, the final sustain discharge waveform in the sustain discharge period S3 is on the side of the Y-electrode, and the narrow waveform must be output to the side of the X-electrode.

In the circuit constitution for realizing this embodiment, the drive waveform is stored in the EP-ROM 43 in the programmable ROM 40 in the circuit constitution of the invention shown in FIG. 9. Concretely speaking, therefore, the embodiment is realized by rewriting the EP-ROM 43.

Described below is an embodiment which is related to a method of using a pulse having a saw-tooth which is different from the method of using narrow voltage pulses NWP.

In this embodiment like the above-mentioned one, use is made of a waveform (saw-tooth erase pulse, hereinafter referred to as SEP) in which the potential changes slowly relative to time as shown in FIG. 14(*b*) instead of using the narrow waveform.

A step (1) in FIG. 13(*b*) represents a state in which there exists a large amount of wall charge prior to applying a saw-tooth waveform SEP. A step (2) represents a state of starting the discharge wherein the output of the saw-tooth waveform SEP is started so that the voltage rises gradually and the discharge takes place at a moment when the sum of the applied voltage and the potential of the charge wall exceeds the threshold value for starting the discharge.

In this embodiment, the discharge takes place with a value which is close to the threshold value, and the scale of discharge at this moment is smaller than that of when a narrow pulse NWP is applied in the step (2) of FIG. 13(*a*).

In a step (3), the charged particles generated by the discharge and floating in the discharge cell are attracted by the wall surface due to the applied voltage and in a step (4), the wall charge and the floating charged particles neutralize each other.

In the state of the step (4), the wall charge has not been completely erased but the amount of the wall charge is very much smaller than that in the step (1). Therefore, no discharge takes place even when a final application voltage Ve is reached. According to this erasing method, dispersion of threshold value at which the discharge starts depending upon the cells is absorbed by the gradient of voltage. Therefore, though the erasing operation is uniformly carried out for all of the cells, the scale of discharge is so small that complete erasing is not accomplished.

By using the saw-tooth waveform SEP just before the quiescent period S4, however, the wall charge can be erased just before entering into the quiescent period S4 owing to the same principle as that of when the narrow voltage waveform that was mentioned above is applied. Thus, half tone noise can be prevented from occurring.

Figure 18:
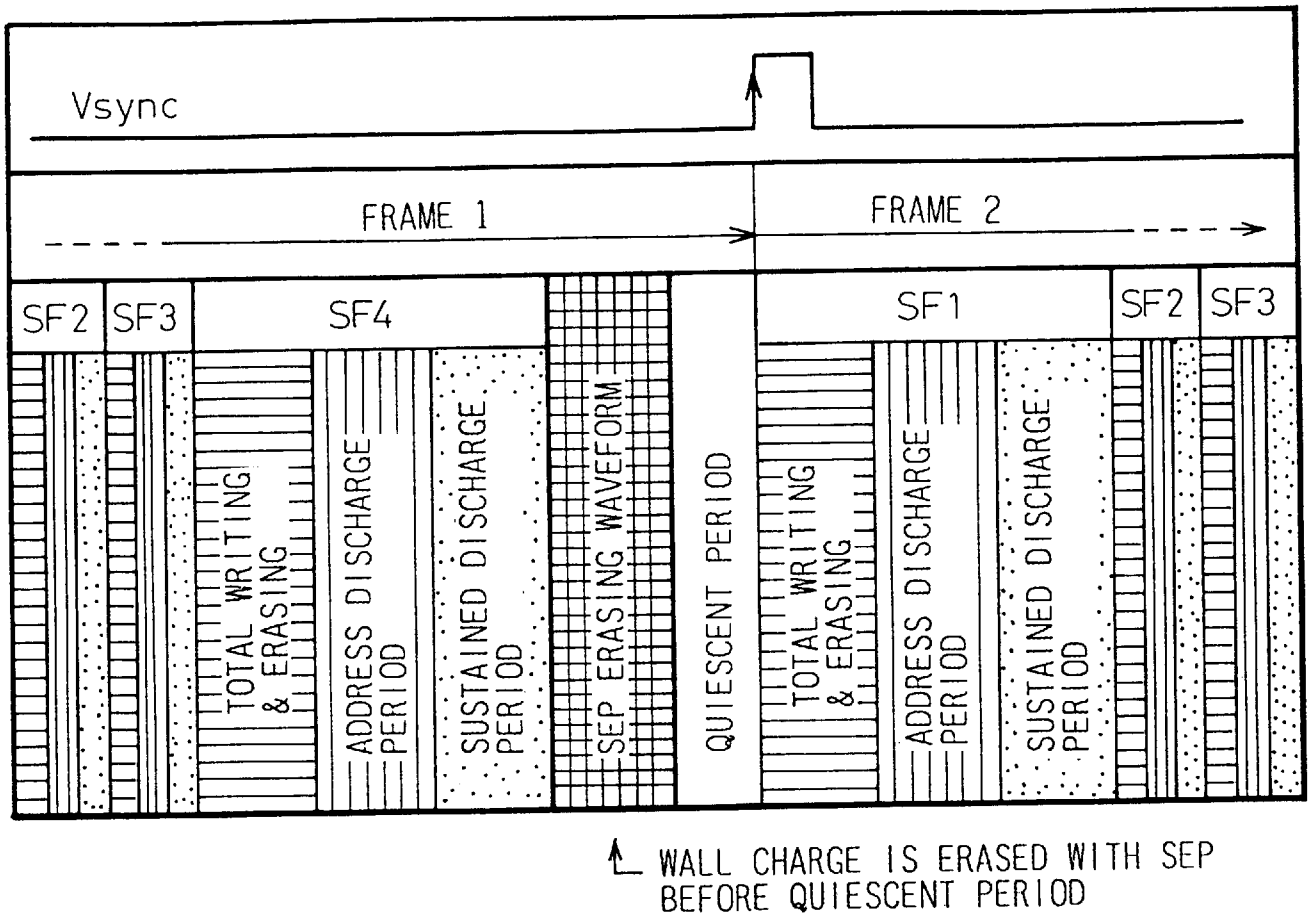
FIG. 18 is a diagram illustrating a drive sequence of when a saw-tooth pulse is applied as a wall charge-erasing wave in the plasma display device of the present invention.

In the present invention, it is desired that the saw-tooth waveform SEP is applied in a period S6 of just after the completion of the sustain discharge period S3 in the final subframe SF4 in the predetermined frame but just before the start of quiescent period S4 as shown in FIG. 18.

FIG. 16 illustrates an example of using the saw-tooth waveform SEP according to the embodiment. In this case, the final sustain discharge waveform during the sustain discharge period S3 is on the side of the Y-electrode, and the saw-tooth waveform SEP must be output to the side of the X-electrode.

In the circuit constitution for realizing this embodiment, the drive waveform is stored in the EP-ROM 43 in the programmable ROM 40 in the circuit of the invention shown in FIG. 9. Concretely speaking, therefore, the embodiment is realized by rewriting the EP-ROM 43, and by providing a saw-tooth waveform-forming circuit 60 as shown in FIG. 9, and by arranging a driver 61 exclusively for the SEP, and a resistor 62 exclusively for the SEP, in the saw-tooth waveform-forming circuit 60.

The driver 61 exclusively for the SEP of the saw-tooth waveform-forming circuit 60 works as a driver for newly and exclusively outputting a saw-tooth waveform SEP which is separate from an X-driver 16 that had heretofore been controlling the X-electrode. The resistor 62 for the SEP is used for realizing a smooth potential change.

According to the second embodiment of the present invention, the plasma display device has a technical constitution in which, when a picture of a frame is displayed on a display device while changing the gradation by combining a plurality of subframes having different degrees of brightness, each of the plurality of subframes is constituted by at least a totally writing and totally self-erasing period, an address period, a sustain discharge period, and a quiescent period determined by a difference between the sum of the periods and a vertical synchronizing period, and each of the plurality of subframes has a sustain discharge period which can be so varied as to exhibit an independent brightness wherein a wall charge-erasing voltage for erasing wall charge after the completion of the sustain discharge is applied to either the X-electrode or the Y-electrode at a time after the completion of the sustain discharge period but just before entering into the quiescent period.

In the above-mentioned constitution, it is desired that the voltage waveform for erasing the wall charge is a rectangular wave NWP having a pulse width narrower than the pulse width of the sustain discharge waveform and that the voltage waveform for erasing the wall charge is a saw-tooth waveform SEP of which the potential changes in a predetermined direction relative to the time.

Described below is the plasma display device according to the third embodiment of the present invention.

According to the third embodiment of the present invention, the half tone noise is prevented or reduced by effecting for each of the frames the control operation in which the final subframe SF in the frame is not turned on as much as possible, or display factors of each of the subframes SF are detected and a subframe having the smallest display factor is arranged as the final subframe SF.

Concretely speaking, it is considered that the half tone noise is caused by a large amount of wall charge used in the sustain discharge operation in the final subframe SF in the frame that is held during the quiescent period. In order to solve this problem, therefore, a method can be contrived in which the final subframe SF is not completely turned on.

This embodiment will now be described.

That is, the concrete constitution of the embodiment is concerned with a plasma display device in which a picture of a frame is gradation-displayed on a display device relying upon a plurality of selective combinations having different degrees of brightness, each of the plurality of subframes including at least an address period and a sustain discharge period and is further provided with a quiescent period which is determined by a difference between the sum of a series of drive periods in a predetermined frame and a vertical synchronizing period, characterized in that the order of the subframes constituting the frame is so rearranged that among said subframes, a subframe having the smallest display factor is arranged as the final subframe in said frame.

In the above-mentioned plasma display device, concretely speaking, the order of the subframes is so rearranged that when there exists a subframe that is not turned on in a predetermined frame, this subframe is arranged as the final subframe or a subframe having the smallest display factor among the subframes constituting the frame is arranged as the final subframe in the frame.

In the circuit for realizing this method as shown in FIG. 9, provision is made of a judging means 50 which judges whether there exists a subframe SF that is not turned on in the frame or which is the subframe having the smallest display factor among the subframes constituting the frame. When the judging means 50 has a judging function for judging which is the subframe having the smallest display factor among the subframes, the circuit is constituted by a display factor detection counter 51, an adder 52 and a comparator 53.

The display factor detection counter 51 counts the number of display data cells for each of the subframes SF and for each of the colors (R, G, B) relying upon the display data that are input, the adder 52 calculates the total number of display data cells in the counter for each of the subframes SF for each of the colors, and the comparator 53 has a function for selecting a subframe SF having the smallest display factor out of the data calculated by the adder 52 for each of the subframes SF.

Described below is the process from detecting the display factor to determining the subframe SF.

First, digital parallel display data input to the plasma display device 1 enters into several counters 51 which count the number of times of turn-on, a counter 51 being provided for each of the bits.

After the counting is finished for all of the cells, the data are added up by the adder 52 for each of the subframes SF and for each of the colors (R, G, B). The total number of display cells of each of the subframes SF is input to the comparator 53 which determines a subframe SF having the minimum number of display cells as the final subframe SF.

At this moment, the subframe SF having the minimum display factor is selected and finally, the final subframe SF is picked up from a sequence of reference subframes SF and this final subframe SF is arranged at the last position.

FIG. 19 illustrates the sequence of subframes SF after the sequence of subframes SF is changed relative to the sequence of reference subframes SF. In this case, when the numbers of display cells are compared between SF1 and SF3, the display factor of the subframe SF1 is 0 which is smaller than the display factor 10 of the subframe SF3. Therefore, the subframe SF1 having a small brightness ratio is arranged at the last position. The sequence of other subframes is SF2, SF3 and SF4 in compliance with the reference sequence of subframes SF.

Relying upon the above-mentioned principle, the subframe SF having a small display factor is arranged just before the quiescent period S4 in order to erase or decrease the half tone noise.

When there exists a subframe SF that is not turned on in the frame, then, the subframe SF that is not turned on may be arranged at the final position of the frame to obtain the same effect.

In this embodiment as described above, it is desired that the basic arrangement of the subframes SF is changed as little as possible when the arrangement of the subframes SF is to be changed depending upon the display factors of the subframes SF or depending upon whether there is a subframe SF that is not turned on. When the arrangement is to be changed, it should be arranged that brightness ratios between the neighboring subframes SF do not differ conspicuously.

When the basic arrangement of the subframes SF is to be changed, it is desired that the subframe SF having a small display factor is arranged at the end.

The fourth embodiment of the present invention is concerned with a plasma display device in which a picture of a frame is gradation-displayed on a display device relying upon a plurality of selective combinations having different degrees of brightness, each of the plurality of subframes including at least an address period and a sustain discharge period and being provided with a quiescent period determined by a difference between the sum of a series of drive periods in the predetermined frame and a vertical synchronizing period, characterized in that all the subframes that are turned on are detected in the predetermined frame, and the order of the subframes is so rearranged that among the subframes having display factors larger than a predetermined value, a subframe having the smallest degree of brightness is arranged at the head of a next frame neighboring said frame. Concretely speaking, in the plasma display device according to the fourth embodiment of the present invention, when all the subframes are turned on in the predetermined frame, the order of the subframes is so changed that a subframe which is not turned on or a subframe having the smallest display factor among the subframes is arranged at the head of the next frame neighboring the above frame. Furthermore, when all of the subframes SF are turned on in the preceding frame, it is desired that a subframe having a minimum brightness among the subframes having display factors of larger than a predetermined value is arranged at the head of the next succeeding frame, in order to visually minimize the problem of half tone noise received by the succeeding frame.

In the embodiment of the present invention as described above, though there is no particular limitation with respect to whether the display factors of the subframes SF are larger than a predetermined value, this value may be set, for example, to 50%.

As for a concrete procedure of operation according to the fourth embodiment, four kinds of subframes SF1 to SF4 are used in the first frame based on the assumption that the subframe SF1 has the smallest brightness and the subframe SF4 has the greatest brightness. When, however, the four subframes SF1 to SF4 all have a display factor of 100% in the first frame, it must be determined in regard to which subframe is to be arranged at the head of the next second frame. In this case, first, the subframe SF1 having the smallest brightness is selected and its display factor is judged.

When the display factor of the subframe SF1 has been set to a predetermined value, e.g., 50%, it is judged concerning whether or not the setpoint value is exceeded. When the display factor of the subframe SF1 is in excess of the predetermined value, i.e., in excess of 50%, the subframe SF1 is arranged at the head of the second frame.

However, when it is judged that the display factor of the subframe SF1 does not exceed the predetermined value, i.e., does not exceed 50%, the subframe SF2 is then selected which is then judged for its display factor by the same procedure as described above. When the display factor of the subframe SF2 exceeds the predetermined value, i.e., exceeds 50%, the subframe SF2 is arranged at the head of the second frame.

However, when it is judged that the display factor of the subframe SF2 does not exceed 50%, then, the subframe SF3 is selected and the same operation is repeated as the one mentioned above. Then, a subframe having a predetermined display factor and having the smallest brightness is arranged at the head of the frame.

Described below is a plasma display device according to the fifth embodiment of the present invention.

That is, in order to solve the above-mentioned problem of half tone noise according to the fourth embodiment of the present invention, the quiescent period S4 between the sustain discharge period S3 and the totally writing and totally self-erasing period S1 of the next frame is shifted to between the totally writing and totally self-erasing period S1 and the address period S2, or is shifted to between the address period S2 and the sustain discharge period S3.

Concretely speaking, the fifth embodiment is concerned with a plasma display device in which a picture of a frame is gradation-displayed on a display device relying upon a plurality of selective combinations having different degrees of brightness, each of the plurality of subframes including at least an address period and a sustain discharge period and being provided with a quiescent period determined by a difference between the sum of a series of drive periods in a predetermined frame and a vertical synchronizing period, characterized in that the quiescent period is provided between the totally writing and totally self-erasing period in the predetermined subframe and the address period.

Figure 20A:
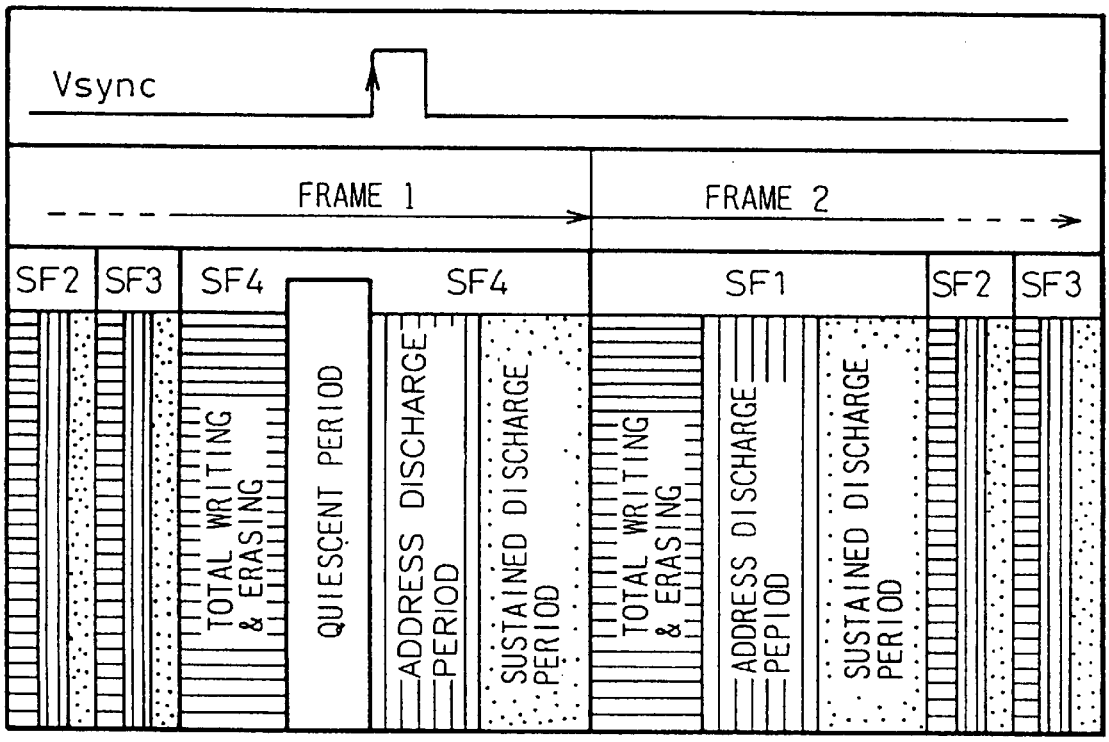
FIGS. 20(*a*) and 20(*b*) are diagrams illustrating drive sequences of when the quiescent period is shifted in the method of driving the plasma display device of the present invention.
Figure 20B:
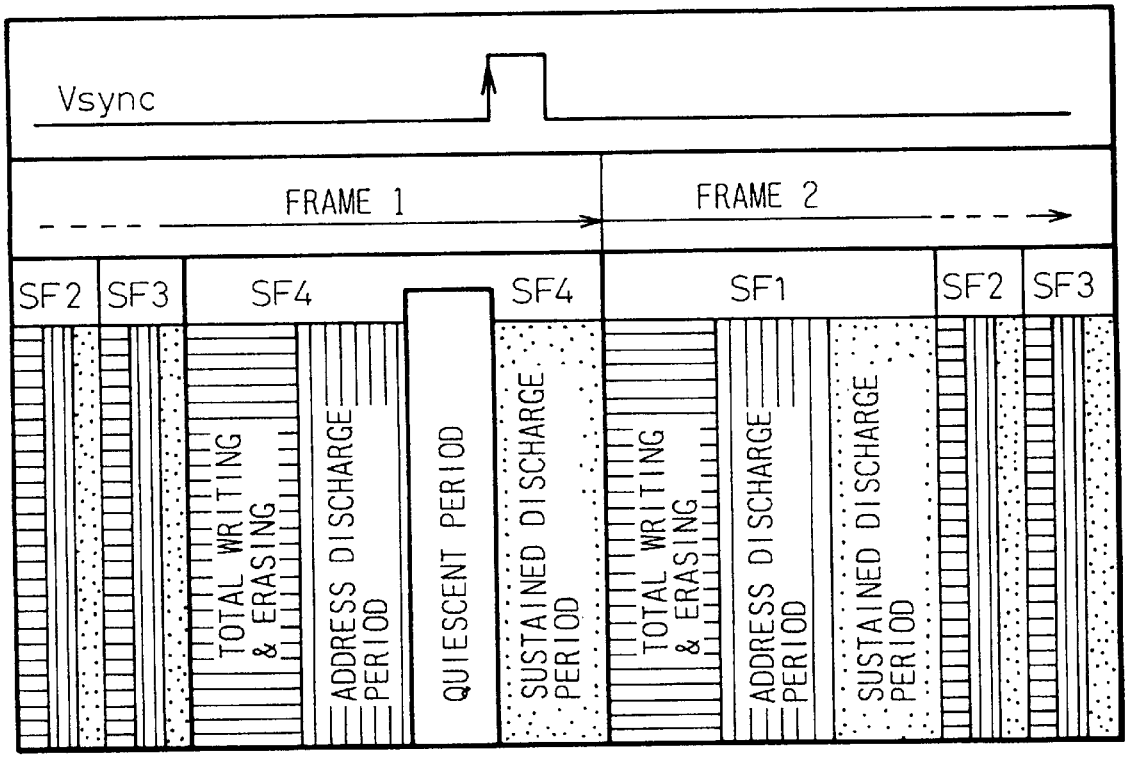

That is, according to this embodiment as illustrated by a drive sequence of FIG. 20, the quiescent period S4 that has heretofore been executed after the sustain discharge period S3 is shifted to any other place in order to suppress the occurrence of half tone noise that stems from the state in which the quiescent period 4 is sandwiched between the sustain discharge period S3 and the totally writing and totally self-erasing period S1.

In FIG. 20(*a*), driving the final subframe SP4 is stopped in the totally writing and totally self-erasing period S1 of the first frame FM1, the quiescent period S4 is shifted to follow the totally writing and totally self-erasing period S1, and the remaining address discharge period processing and the sustain discharge period processing are executed at a moment when a vertical synchronizing signal Vsync of the second frame FM2, which is the next frame, has arrived.

That is, the vertical synchronizing signal Vsync of the next frame arrives after the quiescent period S4. In this embodiment, however, the operation of the next frame is temporarily held despite a vertical synchronizing signal Vsync of the next frame has arrived, and operations of the address period S2 and the sustain discharge period S3 that were not executed in the first frame that is the preceding frame are now executed and, then, the totally writing and totally self-erasing period S1 of the subframe SF1 in the second frame FM2 is executed. Accordingly, no quiescent period S4 arrives after the sustain discharge, and half tone noise is prevented from occurring.

In the prior art, the operation for controlling the subframe SF consisted of three blocks, i.e., totally writing and totally self-erasing period S1, address discharge period S2 and sustain discharge period S3. In this embodiment, however, the operation for controlling the subframe SF must be divided into two blocks, i.e., a former half block (totally writing and totally self-erasing period S1) and the latter half block (address discharge period S2, sustain discharge period S3). Concretely speaking, the display data control unit 18 of the circuit constitution of the invention shown in FIG. 9 must be so changed as to carry out the above-mentioned operation.

In the above-mentioned fifth embodiment, generation of half tone noise is prevented by providing the quiescent period S4 between the totally writing and totally self-erasing period S1 and the address period S2. According to the sixth embodiment shown in FIG. 20(*b*), the quiescent period S4 is provided between the address period S2 and the sustain discharge period S3.

That is, in the drive sequence of the embodiment shown in FIG. 20(*b*), driving the final subframe SF is discontinued in the address discharge period S2 and the remaining sustain discharge period processing is carried out at a moment when a vertical synchronizing signal Vsync of the second frame FM2 which is the next frame has arrived.

Accordingly, no quiescent period S4 appears after the sustain discharge, and half tone noise is prevented from occurring.

The sixth embodiment is concerned with a plasma display device in which a picture of a frame is gradation-displayed on a display device relying upon a plurality of selective combinations having different degrees of brightness, each of the plurality of subframes including at least an address period and a sustain discharge period, characterized in that a quiescent period which is determined by a difference between the sum of a series of drive periods in a predetermined frame and a vertical synchronizing period, is provided between the address period and the sustain discharge period in a predetermined subframe.

The plasma display device 1 according to the present invention employs the aforementioned technical constitution, and makes it possible to prevent or decrease mis-address discharge and mis-sustain discharge in a cell that is turned on, that is caused by the quiescent period S4 which corresponds to a difference between the vertical synchronizing period and the sum of periods of the subframes. Accordingly, the plasma display device features markedly improved display quality.

We claim:

1. A plasma display device in which a picture of a frame is gradation-displayed on a display device relying upon a plurality of selective combinations of subframes, the frame including a plurality of subframes and a quiescent period, the length of the quiescent period being determined by the difference between the sum of the plurality of subframes in the frame and the vertical synchronizing period, the quiescent period being provided at the last portion of the frame, each of the plurality of subframes including at least a reset period, an address period and a sustain discharge period, in that order, wherein a sustain discharge is carried out after the quiescent period and before the reset period of a subframe at the head of a succeeding frame, the reset period includes an applying operation of a reset pulse, the sustain discharge after the quiescent period includes an applying operation of a pulse to cause a potential between electrodes, and a polarity of the potential caused between the electrodes is opposite to the polarity when the reset pulse is applied.

2. A plasma display device according to claim 1, wherein said discharge waveform is applied to either an X-electrode or a Y-electrode arranged in said plasma display device.

3. A plasma display device according to claim 2, wherein said discharge waveform imparted during said discharge waveform-imparting period has been so set that voltages of different polarities are alternately applied to either the X-electrode or the Y-electrode arranged in said-plasma display device.

4. A plasma display device according to claim 2, wherein said discharge waveform imparted during said discharge waveform-imparting period has been so set as to increase a potential difference between the address electrode and either the X-electrode or the Y-electrode arranged in said plasma display device.

5. A plasma display device according to claim 1, wherein said discharge waveform is constituted by a set of waveforms that are applied to both an X-electrode and a Y-electrode arranged in said plasma display device.

6. A plasma display device according to claim 1, wherein said discharge waveform-imparting period is provided at the head position of each of said subframes.

7. A plasma display device according to claim 1, wherein the number of sustain discharge events in the sustain discharge period in each of said subframes is decreased by a number of times that correspond to the number of pulses in the discharge waveform imparted during said discharge waveform-imparting period.

8. A plasma display device according to claim 1 wherein said reset period, said address period and said sustain discharge period are so set as to shorten as much as possible the interval between a discharge waveform imparted during the discharge waveform-imparting period and a reset waveform in a later reset period that follows said discharge waveform-imparting period.

9. A plasma display device according to claim 8, wherein an interval between said later discharge waveform imparted during said discharge waveform-imparting period and a reset period following said discharge waveform-imparting period is set to be not longer than 5 $\mu$s.

10. A plasma display device according to claim 1, wherein the reset pulse is applied to a first electrode, and the pulse in the sustain discharge is applied to a second electrode.

11. A plasma display device in which a picture of a frame is gradation-displayed on a display device relying upon a plurality of selective combinations of subframes each having different degrees of brightness, each of the plurality of subframes including at least an address period and a sustain discharge period, wherein a wall charge-erasing voltage for erasing the wall charge after the completion of the sustain discharge is applied to a discharge electrode during an interval between a sustain discharge period in a final subframe in a predetermined frame and a quiescent period which is determined by a difference between the sum of a series of drive periods in said predetermined frame and a vertical synchronizing period.

12. A plasma display device according to claim 10, wherein said wall charge-erasing voltage waveform has a pulse width which is narrower than the pulse width of said sustain discharge waveform.

13. A plasma display device according to claim 10, wherein said wall charge-erasing voltage waveform is a saw-tooth waveform so that the potential thereof changes in a predetermined direction with respect to the time.

14. A plasma display device in which a picture of a frame is gradation-displayed on a display device relying upon a plurality of selective combinations of subframes having different degrees of brightness, each of the plurality of subframes including at least an address period and a sustain discharge period, wherein the order of the subframes constituting the frame is so rearranged that among said subframes, a subframe having the smallest display factor is arranged as the final subframe in said frame.

15. A plasma display device in which a picture of a frame is gradation-displayed on a display device relying upon a plurality of selective combinations of subframes having different degrees of brightness, each of the plurality of subframes including at least an address period and a sustain discharge period, wherein the subframes that are all turned on are detected in the predetermined frame, and the order of the subframes is so rearranged that among the subframes having display factors larger than a predetermined value, a subframe having the smallest degree of brightness is arranged at the head of a next frame neighboring said frame.

16. A plasma display device in which a picture of a frame is gradation-displayed on a display device relying upon a plurality of selective combinations of subframes having different degrees of brightness, each of the plurality of subframes including at least a reset period, an address period and a sustain discharge period, wherein a quiescent period, which is determined by a difference between the sum of a series of drive periods in a predetermined frame and a vertical synchronizing period, is provided between the reset period and the address period in a predetermined subframe.

17. A plasma display device according to claim 15 wherein the moment at which said quiescent period terminates in said frame is brought into synchronism with the rise of a vertical synchronizing signal, and the unexecuted subframes in said frame are executed after said vertical synchronizing signal has risen until a subframe arranged at the head of the next frame is executed.

18. A plasma display device in which a picture of a frame is gradation-displayed on a display device relying upon a plurality of selective combinations of subframes having different degrees of brightness, each of the plurality of subframes including at least an address period and a sustain discharge period, wherein a quiescent period, which is determined by a difference between the sum of a series of drive periods in a predetermined frame and a vertical synchronizing period, is provided between the address period and the sustain discharge period in a predetermined subframe.

19. A plasma display device in which a picture of a frame is gradation-displayed on a display device relying upon a plurality of selective combinations of subframes, the frame including a plurality of subframes and a quiescent period, the length of the quiescent period being determined by the difference between the sum of the plurality of subframes in the frame and the vertical synchronizing period, the quiescent period being provided at the last portion of the frame, each of the plurality of subframes including at least a reset period, an address period and a sustain discharge period, in that order, wherein a sustain discharge is carried out after the quiescent period and before the reset period of a subframe at the head of a succeeding frame.

* * * * *